US009723922B2

(12) United States Patent
Chen

(10) Patent No.: US 9,723,922 B2
(45) Date of Patent: Aug. 8, 2017

(54) SLIDABLE CABINET PULLOUT APPARATUS AND METHOD OF USE

(71) Applicant: Hardware Resources, Inc., Bossier City, LA (US)

(72) Inventor: Alan Chen, Lewisville, TX (US)

(73) Assignee: Hardware Resources, Inc., Bossier City, LA (US)

( * ) Notice: Subject to any disclaimer, the term of this patent is extended or adjusted under 35 U.S.C. 154(b) by 0 days.

(21) Appl. No.: 15/173,285

(22) Filed: Jun. 3, 2016

(65) Prior Publication Data

US 2016/0278521 A1 Sep. 29, 2016

Related U.S. Application Data

(63) Continuation-in-part of application No. 14/797,643, filed on Jul. 13, 2015, now Pat. No. 9,565,936.
(Continued)

(51) Int. Cl.
*A47B 88/04* (2006.01)
*A47B 88/956* (2017.01)
(Continued)

(52) U.S. Cl.
CPC ..... *A47B 88/0407* (2013.01); *A47B 88/407* (2017.01); *A47B 88/42* (2017.01);
(Continued)

(58) Field of Classification Search
CPC ..... A47B 88/0055; A47B 88/0407; A47B 2088/0492
See application file for complete search history.

(56) References Cited

U.S. PATENT DOCUMENTS 2,254,431 A 9/1941 Levine
2,987,364 A 6/1961 Fall
(Continued)

FOREIGN PATENT DOCUMENTS

EP 0582775 A1 2/1994

OTHER PUBLICATIONS

"Adjustable PullOut Cabinet Rack for 14" Deep Pantry Systems," Side Lines®, sidelinesinc.com, SKU#B01545Sc14, http://www.sidelinesinc.com/product_display.php?pid=71.
(Continued)

*Primary Examiner* — Daniel Rohrhoff
(74) *Attorney, Agent, or Firm* — Shultz & Associates, P.C.

(57) ABSTRACT

Disclosed is a pullout apparatus having side access and designed for simple, adjustable, and accurate installation within a pre-existing cabinet space. The apparatus, slidably mounted within the cabinet space, comprises a top slide assembly mounted to a cabinet carcass and a drawer box. The drawer box is automatically centered on a base slide box. The base slide box is comprised of a slotted template slidingly engaged with a frame, where the frame is mounted to the cabinet carcass. Slide rail assemblies connect the slotted template to the frame. A pin block on the underside of a fixed shelf of the drawer box automatically centers the drawer box on the slotted template. A face plate adjustment mechanism provides for three dimensional alignment of the face plate with surrounding cabinets. An alternate embodiment comprises a mounting bracket providing three dimensional adjustability of the upper drawer slide.

11 Claims, 26 Drawing Sheets

Related U.S. Application Data

(60) Provisional application No. 62/076,602, filed on Nov. 7, 2014.

(51) Int. Cl.

| | |
|---|---|
| ***A47B 88/407*** | (2017.01) |
| ***A47B 88/43*** | (2017.01) |
| ***A47B 88/42*** | (2017.01) |
| ***A47B 88/493*** | (2017.01) |
| ***A47B 88/57*** | (2017.01) |

(52) U.S. Cl.

CPC ..... *A47B 88/43* (2017.01); *A47B 88/493* (2017.01); *A47B 88/57* (2017.01); *A47B 88/956* (2017.01); *A47B 2088/422* (2017.01); *A47B 2210/0032* (2013.01); *A47B 2210/0035* (2013.01); *A47B 2210/0054* (2013.01); *A47B 2210/0056* (2013.01); *A47B 2210/0062* (2013.01)

(56) References Cited

U.S. PATENT DOCUMENTS

| | | | | |
|---|---|---|---|---|
| 3,874,756 | A | 4/1975 | Greene | |
| 4,621,876 | A | 11/1986 | Reimer | |
| 4,653,818 | A | 3/1987 | DeBruyn | |
| 5,671,987 | A | 9/1997 | Hommes | |
| 5,944,400 | A | 8/1999 | Fulterer | |
| 5,992,956 | A | 11/1999 | Slivon | |
| 6,135,584 | A | 10/2000 | Happ | |
| 6,199,966 | B1 | 3/2001 | Fulterer | |
| 6,231,138 | B1 | 5/2001 | Janson | |
| 6,682,159 | B2 | 1/2004 | Compagnucci | |
| 6,688,708 | B1 | 2/2004 | Janson | |
| 7,306,301 | B2 | 12/2007 | Walburn | |
| D596,424 | S | 7/2009 | Noe et al. | |
| RE41,725 | E | 9/2010 | Walburn | |
| 7,832,816 | B2 | 11/2010 | Compagnucci | |
| 8,047,621 | B2 | 11/2011 | Walburn | |
| 8,109,581 | B1 | 2/2012 | Lazenby | |
| 9,101,213 | B2 * | 8/2015 | McGregor | A47B 88/0407 |
| 9,259,087 | B1 * | 2/2016 | Hsiao | A47B 88/0407 |
| 2004/0232810 | A1 | 11/2004 | Kreyenkamp | |
| 2006/0001337 | A1 * | 1/2006 | Walburn | A47B 88/0485 312/334.27 |
| 2009/0267470 | A1 | 10/2009 | Compagnucci | |
| 2012/0049713 | A1 * | 3/2012 | Tingle | A47B 88/0485 312/334.33 |
| 2012/0217214 | A1 * | 8/2012 | Thomsen | A47B 77/16 211/79 |
| 2012/0286116 | A1 * | 11/2012 | Gasser | A47B 88/0055 248/221.11 |
| 2013/0088134 | A1 * | 4/2013 | Varner | A47B 88/20 312/348.1 |
| 2014/0139080 | A1 | 5/2014 | Pan | |
| 2014/0239787 | A1 * | 8/2014 | Mensa' | A47B 88/0055 312/348.4 |
| 2016/0007744 | A1 * | 1/2016 | Fasino | A47F 3/06 312/330.1 |
| 2016/0128470 | A1 * | 5/2016 | Chen | A47B 88/10 312/348.4 |
| 2016/0128474 | A1 * | 5/2016 | Chen | A47B 88/10 312/333 |

OTHER PUBLICATIONS

"PullOut Pantry 300mm Module Chrome Finish Baskets," ELRACO, http://elraco.com.au/product_info.php/standardpantryunitpulloutpantry300mmmodulechromefinishbasketsp9496.

"PullOut Pantry Chrome 5200 Series RevAShelf," CMS Cabinetmaker's Supply, cabinetmakerssupply.com, http://www.cabinetmakerssupply.com/pull_out_pantry_chrome_5200_series_rev_a_shelf_cabinet_wire_5593_prd1.htm.

"RevAShelf &ldqou;Premiere Chrome SoftClose Pullout Pantry," kitchensource, kitchensource.com, http://www.kitchensource.com/pantry/rv574309.htm.

"Pantry Pull Out Slide FF 777 200 Kg," tt thuresson™, http://www.thuressontrading.com/pantrypulloutslidefr777200kg.html.

* cited by examiner

SLIDABLE CABINET PULLOUT APPARATUS AND METHOD OF USE

CROSS-REFERENCE TO RELATED APPLICATIONS

This application is a Continuation-In-Part of application Ser. No. 14/797,643, filed Jul. 13, 2015, which claims the benefit of U.S. Provisional Patent Application No. 62/076,602 filed on Nov. 7, 2014. Each patent application identified above is incorporated herein by reference in its entirety to provide continuity of disclosure.

FIELD OF THE DISCLOSURE

The present disclosure relates to cabinet structure, cabinets, and drawers. In particular, the disclosure relates to a slidable pullout cabinet with an adjustable face plate and an adjustable mounting bracket.

BACKGROUND OF THE DISCLOSURE

Modern kitchens place a premium on sufficient usage of storage for utensils, dry goods, and can goods. In the past, the traditional kitchen includes simple shelving to accommodate these items. However, simple shelving suffers from the drawback of unusable rear areas in corners where items are difficult to see and reach.

In an effort to overcome these difficulties, the prior art has responded by various cabinet pull out devices.

For example, U.S. Pat. No. 7,832,816 to Compagnucci discloses a frame used to support racks that slide out from a cabinet and rotate around a vertical axis. The frame comprises a rectangular structure formed of two uprights connected by upper and lower cross-pieces. The cross-pieces are coupled to telescopic sliding assemblies mounted within the cabinet. The cross-pieces are pinned to the sliding assemblies to allow the rack to rotate approximately 90° on a vertical axis such that the frame becomes parallel with the face of the cabinet only at a fully deployed position. Stops mounted to the cross-pieces prevent the frame from sliding to a stored position within the cabinet before the frame is rotated 90° such that the frame is parallel with the sliding assemblies. The device does not provide a self centering mounting base or an adjustable face plate.

U.S. Pat. No. 6,199,966 to Fulterer discloses a pullout device for a tall cupboard. The device comprises upper and lower sliding assemblies including telescopically sliding rails and running rollers. A vertically extending pullout frame, which is formed of vertical front and rear bars and horizontal upper and lower bars, is secured to the sliding assemblies. The front and rear bars and the upper and lower bars can be formed as telescopic members, permitting to adapt the device to the dimensions of the tall cupboard. A plurality of baskets can be hung between the vertical. A frontal screen is secured to the front vertical bar. The frontal screen is not easily adjustable.

U.S. Reissue Pat. No. RE41,725 to Walburn discloses a drawer slide system providing desired access and stability for a side access drawer. The system comprises a drawer having a front wall, a back wall, a base, and plurality of shelves connected between the front and back walls. The base includes a pair of vertical webs. The base is slidably mounted on an assembly comprised of one horizontally oriented drawer slide and a pair of vertically oriented drawer slides mounted to vertical webs of the base. The drawer does not provide an adjustable face plate.

Despite the advantages of the prior art, a major drawback has been that the pullout devices disclosed are not easily installed or adjusted. The prior art fails to disclose or suggest a pullout cabinet device that is easily and accurately mounted and which is easily adjustable to accommodate alignment with adjacent cabinets. Therefore, there is a need for a slidable pullout apparatus which is easily and accurately installed in a preexisting cabinet space where the apparatus is adjustable to ensure a coordinated and professional look which assimilates with cabinets already installed.

SUMMARY OF THE DISCLOSURE

In a preferred embodiment, a pantry pullout apparatus is comprised of a drawer box slidably mounted within a cabinet carcass. The drawer box is comprised of a rear panel separated from a front panel by a plurality of adjustable shelves and fixed shelves. The drawer box is fixed to a base slide box. The base slide box is comprised of a slotted template slidingly engaged with a frame, where the frame is mounted to the cabinet carcass. Slide rail assemblies connect the slotted template to the frame. A pin block on the underside of a fixed shelf automatically centers the drawer box on the slotted template. A top slide assembly is mounted to the drawer box and the cabinet carcass. The top slide assembly can be adjusted horizontally and vertically with respect to the drawer box and cabinet carcass to accommodate particular dimensions of various drawer boxes and cabinet carcasses. A cosmetic cover is attached to the slotted template and hides the slide rail assemblies connecting the slotted template to the base slide box from view.

In a preferred embodiment, a decorative face plate is attached to the front panel of the drawer box with an adjustable face plate mounting system. A slotted, rectangular bracket providing horizontal and vertical adjustment capability is connected to the face plate. A standoff assembly slidably engages the slot in the bracket and is fixed to the front panel. In an alternate embodiment, a T-nut is fixedly engaged with the front panel and an adjustable set screw is threadably engaged with the T-nut. The adjustable set screw abuts the slotted bracket to provide depth adjustment capability.

In an alternate embodiment, a cabinet pullout apparatus is comprised of a drawer box slidably connected within a cabinet carcass by a set of lower, undermount drawer slide assemblies and an upper, adjustable, ball-bearing drawer slide. The drawer box is comprised of a rear panel separated from a front panel by a plurality of adjustable shelves and fixed shelves. The lower slide assemblies are mounted to the cabinet carcass and a lower fixed shelf. The upper drawer slide is mounted to the cabinet carcass and an upper fixed shelf. The upper drawer slide is adjustable in three directions to prevent binding. A decorative face plate may be attached to the front panel of the drawer box with the adjustable face plate mounting system.

BRIEF DESCRIPTION OF THE DRAWINGS

The disclosed embodiments will be described with reference to the accompanying drawings. Like pieces in different drawings are referenced by the same number.

DETAILED DESCRIPTION

Figure 1A:
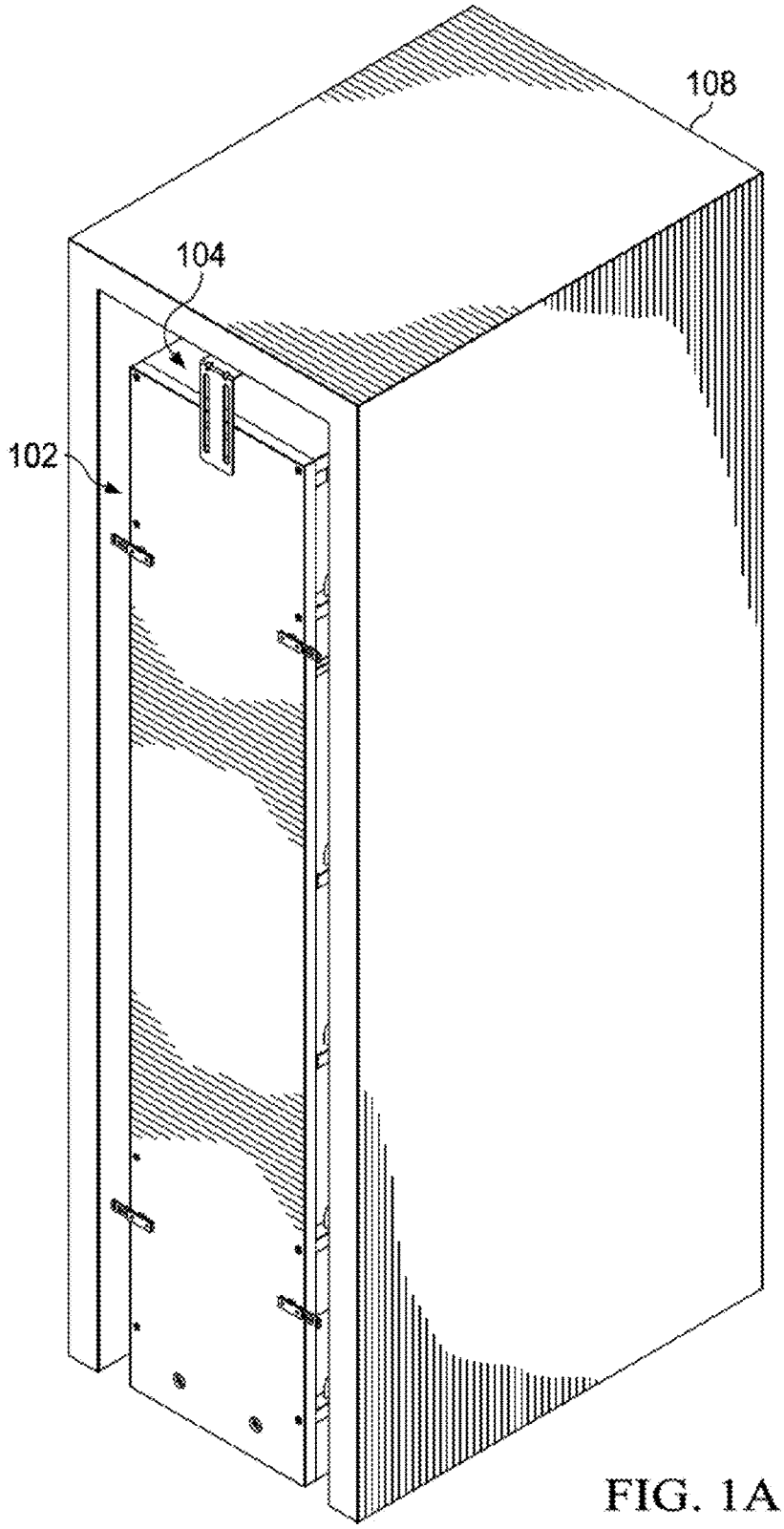
FIG. 1A is an isometric view of a preferred embodiment in a stowed position.
Figure 1B:
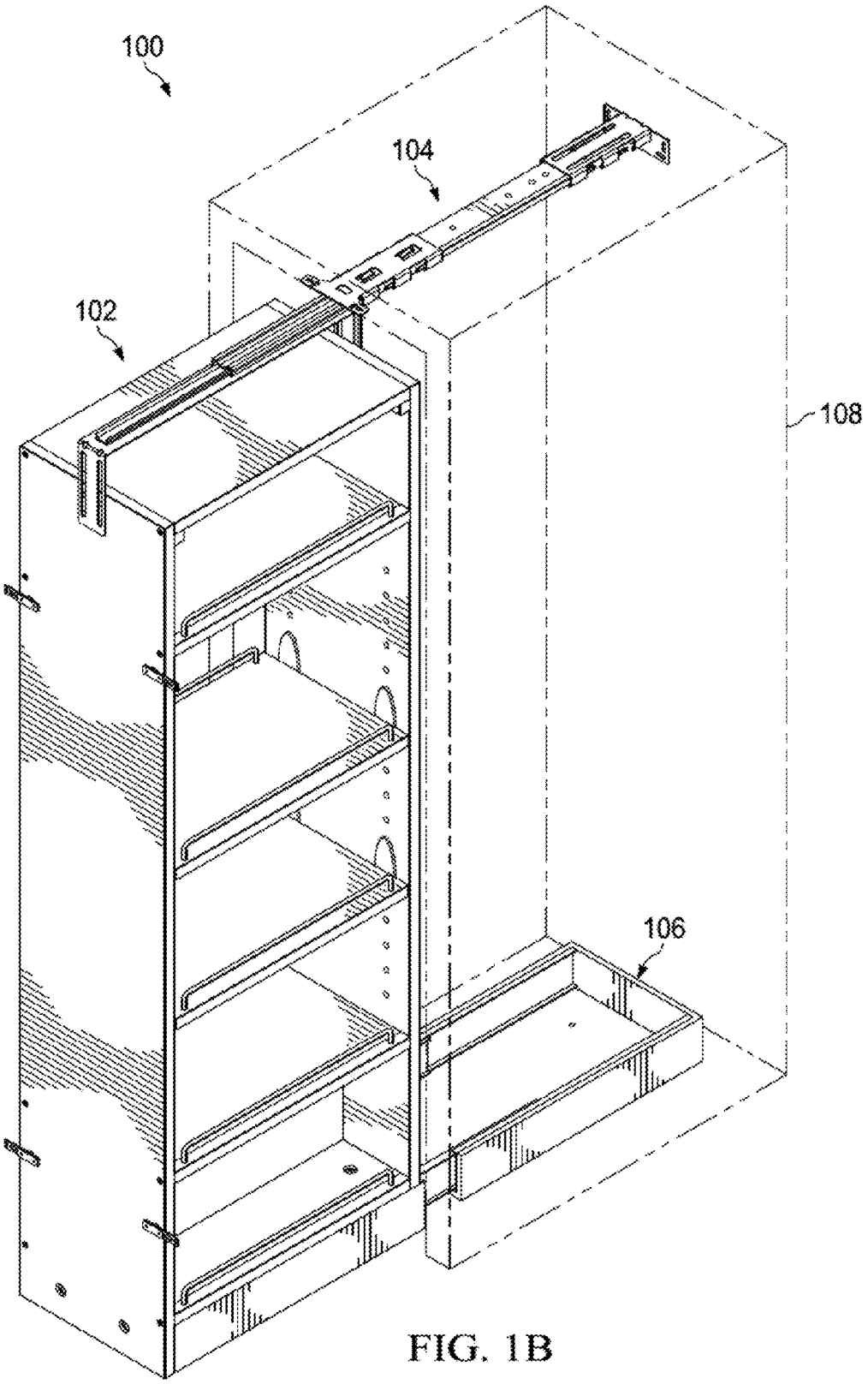
FIG. 1B is an isometric view of a preferred embodiment in a deployed position.

Referring to FIGS. 1A and 1B, pantry pullout apparatus 100 comprises drawer box 102 connected to top slide assembly 104 and base slide box 106. Drawer box 102 is connected to and slidable within base slide box 106. Top slide assembly 104 and base slide box 106 are mounted to cabinet carcass 108. Drawer box 102 is slidable between a "stowed" position within the cabinet carcass (FIG. 1A) and a "deployed" position (FIG. 1B). In the stowed position, the drawer box and its contents are hidden from view. In the deployed position, the contents stored on the shelves are visible and capable of being easily reached from either side.

Figure 2:
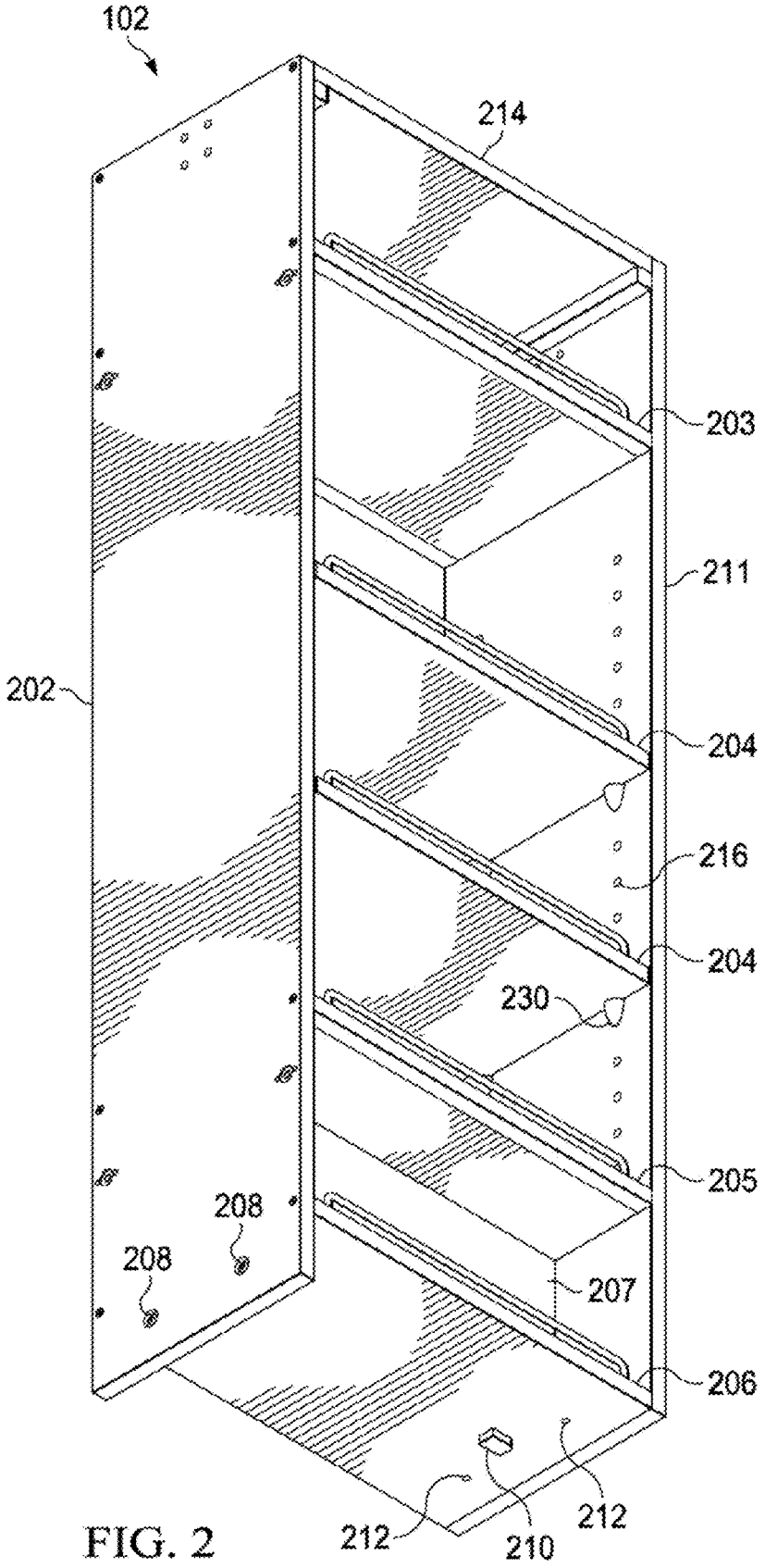
FIG. 2 is an isometric view of a drawer box of a preferred embodiment.

Referring to FIG. 2, drawer box 102 is generally rectangular having a closed top and bottom with open sides. Drawer box 102 comprises front panel 202 connected to rear panel 211 by top panel 214. Fixed shelves 203, 205, and 206 are rigidly connected to and generally perpendicular with both front panel 202 and rear panel 211. A plurality of adjustable shelves 204 span the distance between front panel 202 and rear panel 211. The vertical position of each adjustable shelf 204 can be changed by repositioning supporting pins 230 in a series of evenly spaced and aligned mounting holes 216 in front panel 202 and rear panel 211 located between fixed shelves 203 and 205. Vertical partition 207 extends between and is connected to fixed shelves 205 and 206. Pin block 210 is rigidly secured to the underside of fixed shelf 206 and is positioned on the longitudinal central axis of fixed shelf 206. Front panel 202 includes a pair of mounting holes 208 proximate fixed shelf 206. Fixed shelf 206 includes a pair of mounting holes 212. In a preferred embodiment, drawer box 102 is formed of wood, particle board, or polyvinyl chloride (PVC).

Figure 3:
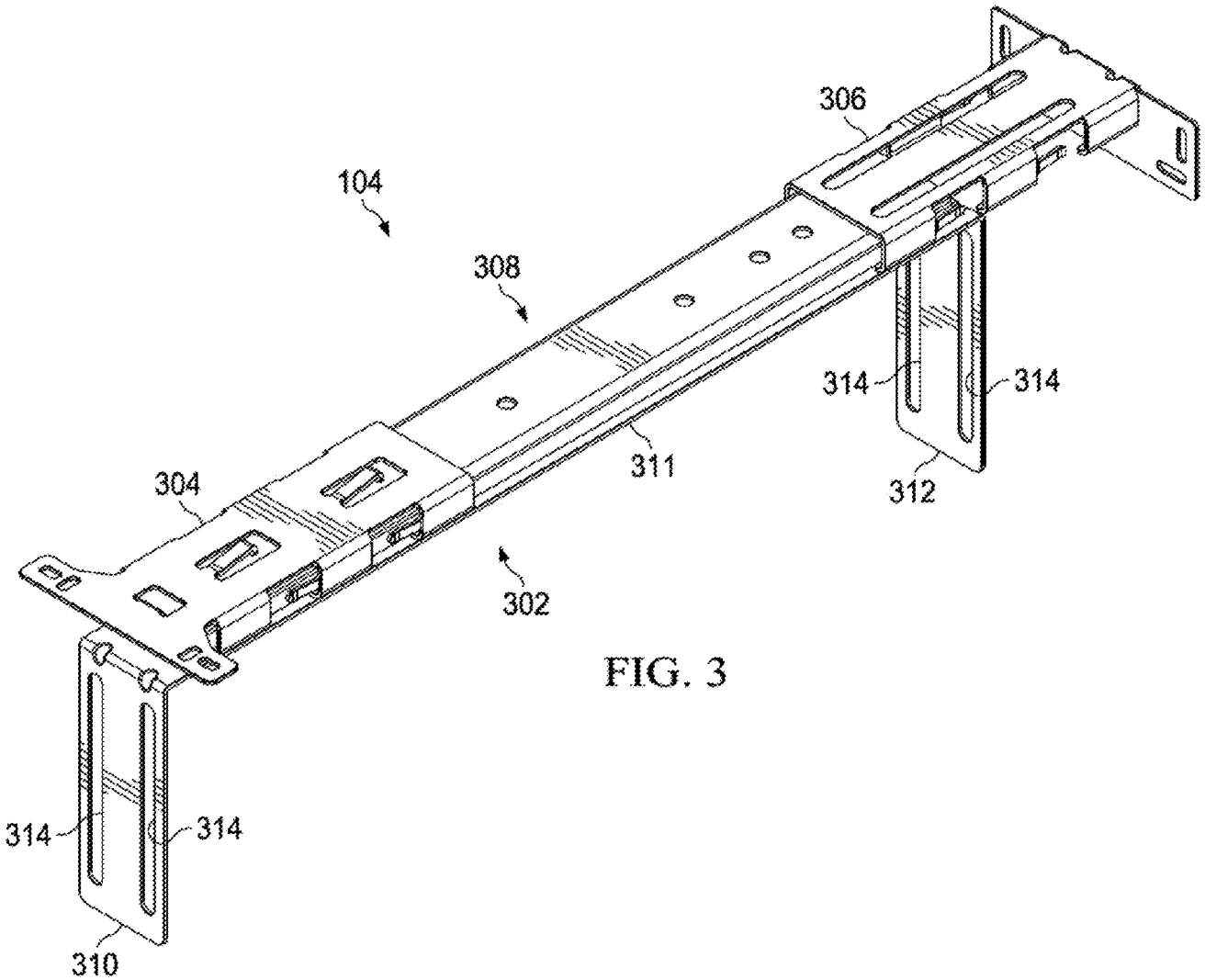
FIG. 3 is an isometric view of a top slide assembly of a preferred embodiment.

Referring to FIG. 3, top slide assembly 104 is shown. Top slide assembly 104 comprises rail assembly 308 mounted to "U" bracket 302. "T" bracket 304 and "L" bracket 306 are both adjustably engaged with rail assembly 308 and adjustably connected to the cabinet carcass. "U" bracket 302 comprises bridge 311 having a length approximately equal to the length of the fixed and adjustable shelves. Flanges 310 and 312 extend generally perpendicularly from the ends of bridge 311. Flanges 310 and 312 include mounting slots 314. In a preferred embodiment, the components of top slide assembly 104 are formed of steel, preferably stainless steel.

Figure 4:
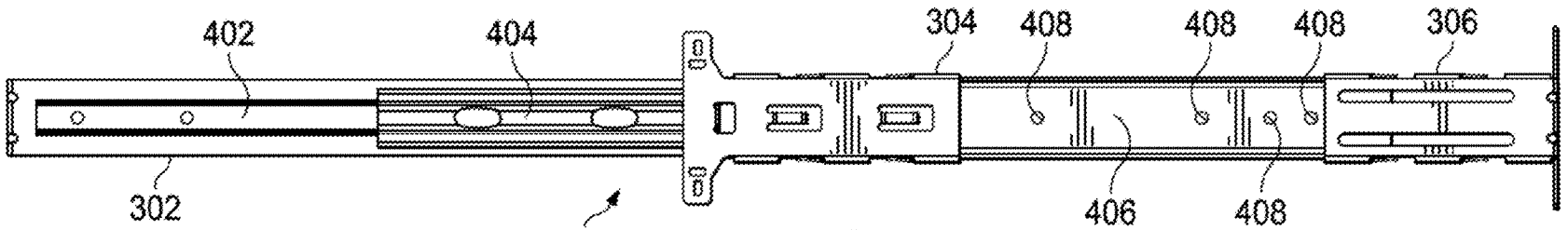
FIG. 4 is an elevation view of a top slide assembly of a preferred embodiment.

As shown in FIG. 4, rail assembly 308 comprises inner rail 402 connected to "U" bracket 302. Inner rail 402 slidingly engages intermediate rail 404. Intermediate rail 404 sliding engages outer rail 406. In a preferred embodiment, the inner rail and intermediate rails are engaged by typical race and caged ball-bearing assemblies. In alternate embodiments, different numbers of slide rails and alternate sliding engagements may be employed. "T" bracket 304 and "L" bracket 306 are adjustably attached to outer rail 406.

Outer rail 406 includes linearly aligned mounting holes 408. Mounting holes 408 are positioned along the longitudinal center axis of outer rail 406.

Figure 5A:
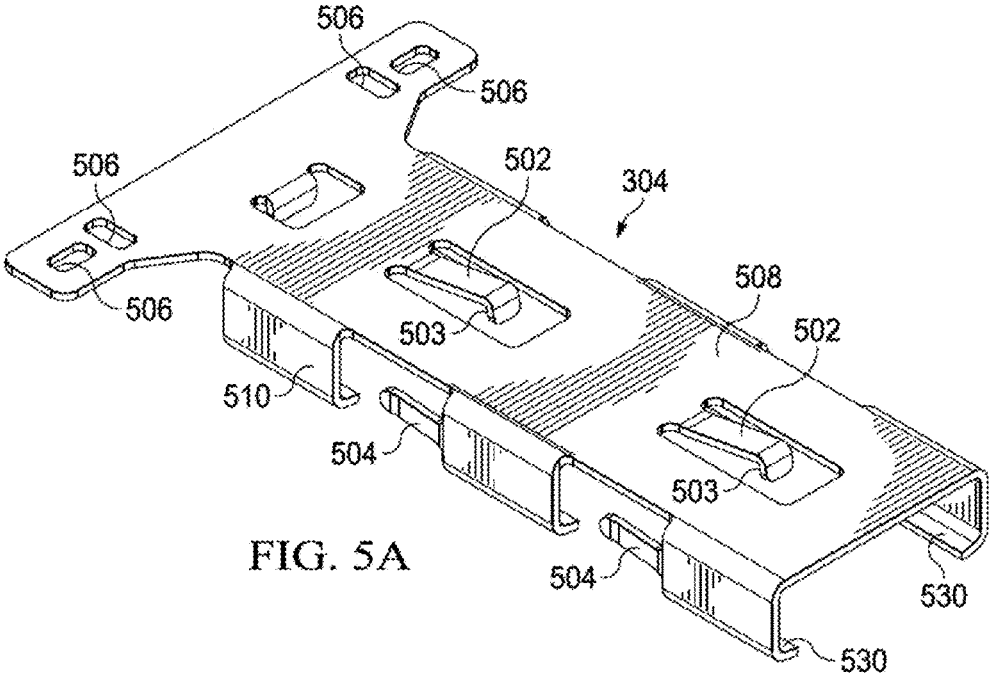
FIG. 5A is an isometric view of a "T" bracket of a preferred embodiment.
Figure 5B:
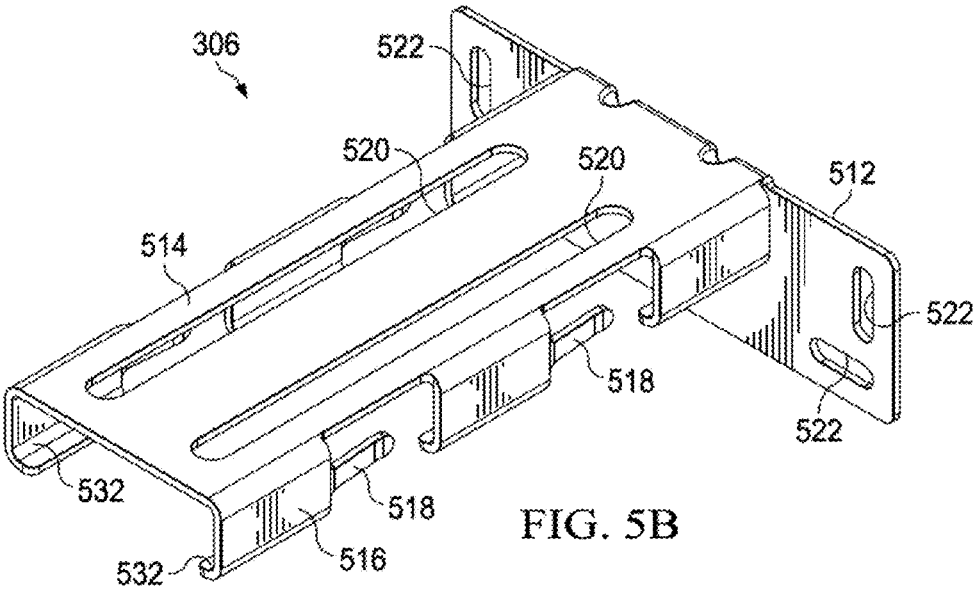
FIG. 5B is an isometric view of an "L" bracket of a preferred embodiment.

Referring to FIGS. 5A and 5B, brackets 304 and 306 are shown. Brackets 304 and 306 releasably engage rail assembly 308. "T" bracket 304 has a generally "U" shaped cross-section comprised of web 508 integrally formed with and separating sides 510. Tabs 504 extend from each of sides 510. Tabs 504 are angled inward towards web 508 such that they act as a spring and provide an inward bias. Flexible tabs 502 extend from web 508. Each flexible tab 502 includes hook 503 sized to engage mounting holes 408 on outer rail 406. Sides 510 extend from web 508 and include curve 530. "T" Bracket 304 includes mounting holes 506.

"L" bracket 306 has a generally "U" shaped cross-section comprised of web 514 integrally formed with sides 516. Web 514 includes mounting slots 520. Flange 512 extends generally perpendicularly from web 514 and includes mounting slots 522. Sides 516 extend from web 514 and include curve 532. Tabs 518 extend from each of sides 516. Tabs 518 are angled inward towards web 514 such that they act as a spring and provide an inward bias.

Figure 6:
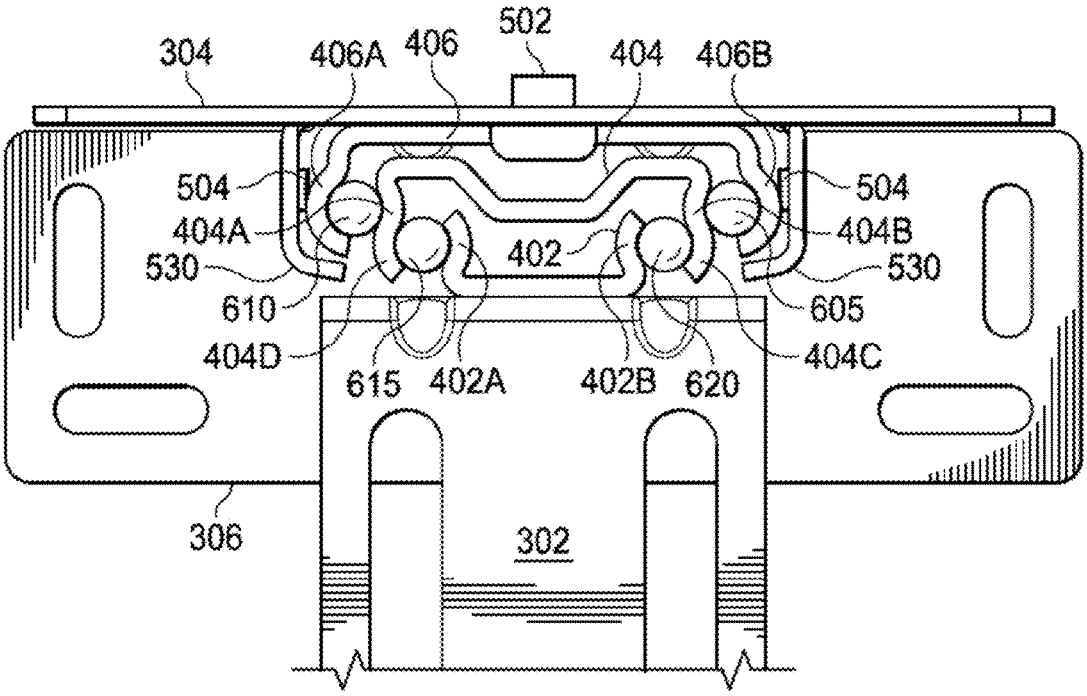
FIG. 6 is a partial elevation view of a top slide assembly of a preferred embodiment.

Referring to FIG. 6, rail assembly 308 is shown attached to "U" bracket 302. Inner rail 402 is nested within intermediate rail 404. Intermediate rail 404 is nested within outer rail 406.

Intermediate rail 402 includes bearing race 402*a* and rail bearing race 402*b*. Intermediate rail 404 includes bearing race 404*c* and bearing race 404*d*. The bearing races cooperate to position ball-bearing string 615 and ball-bearing string 620. Intermediate rail 404 also includes bearing race 404*a* and bearing race 404*b*. Outer rail 406 includes bearing race 406*a* and bearing race 406*b*. The bearing races cooperate to locate ball-bearing strings 605 and 610. Curves 530 hook under outer rail 406 and tabs 504 abut outer rail 406. Tabs 504 and 518 accommodate a range of widths of outer rail 406.

Figure 7:
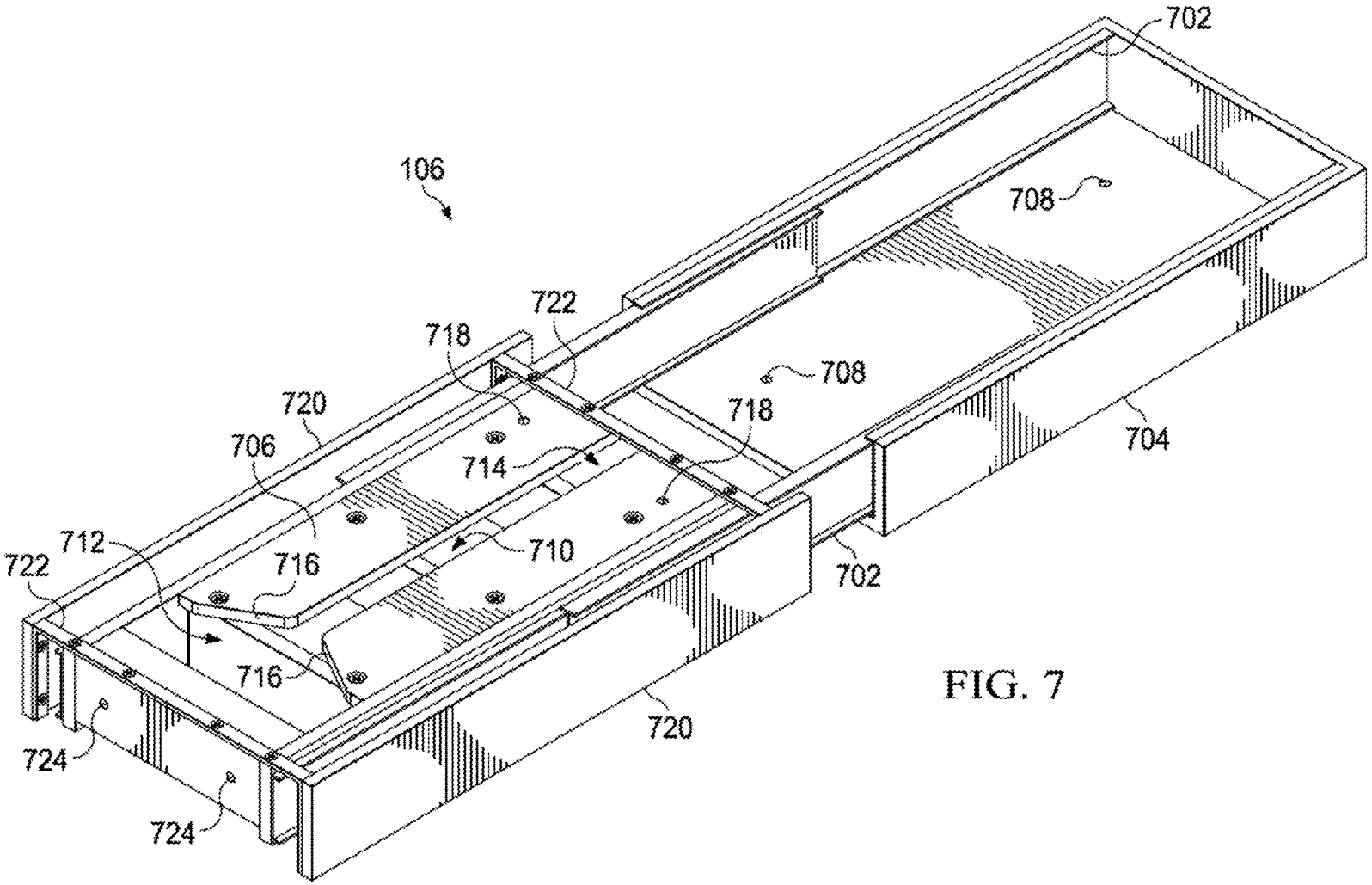
FIG. 7 is an isometric view of a base slide box of a preferred embodiment.

Referring to FIG. 7, base slide box 106 is shown. In a preferred embodiment, base slide box 106 is formed of wood, particle board, or polyvinyl chloride (PVC). Rail assembly 702 slidably connects frame 704 to template 706. In a preferred embodiment, rail assembly 702 incorporates three sliding rails with ball-bearing carriages; however, alternate forms of drawer rail assemblies may be employed. Frame 704 includes a plurality of mounting holes 708. Template 706 includes slot 710 located on its central longitudinal axis. Slot 710 has a first end 712 and a second end 714. Redirecting surfaces 716 are positioned at first end 712 of slot 710. In a preferred embodiment, redirecting surfaces 716 are angled generally 45° from the longitudinal axis of slot 710, however angles in the range of 30-60° would suffice. Template 706 includes mounting holes 718 either side of slot 710 proximate second end 714. A front face of template 706 includes mounting holes 724. Cosmetic cover 720 is comprised of two panels connected to each other by a pair of braces 722. Braces 722 are mounted to template 706 at first end 712 and second end 714. Cosmetic cover 720 hides rail assembly 702 from view when drawer box 102 is in the deployed position. In an alternate embodiment, no cosmetic cover is attached to base slide box 106.

Figure 8A:
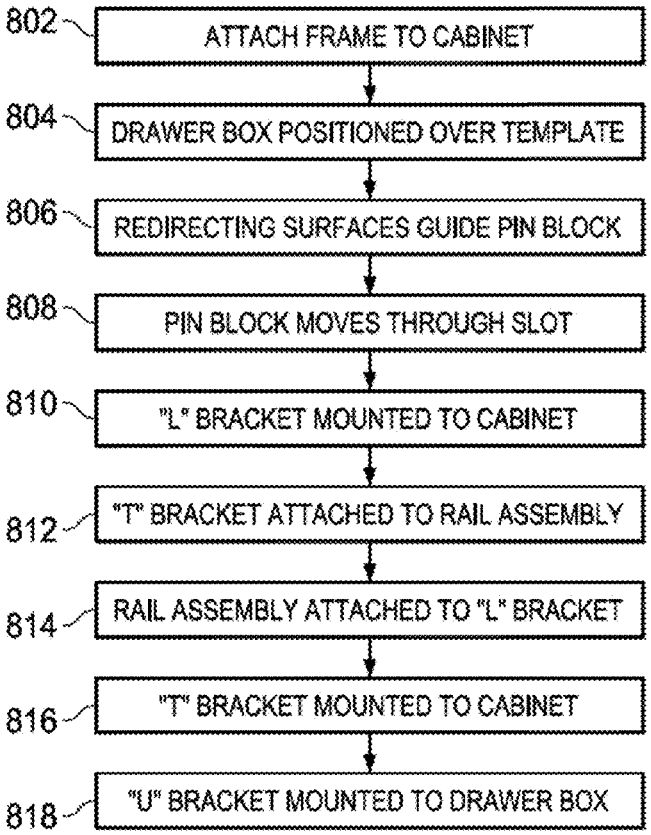
FIG. 8A is a flowchart of the steps involved in installing a drawer box in a cabinet of a preferred embodiment.
Figure 8B:
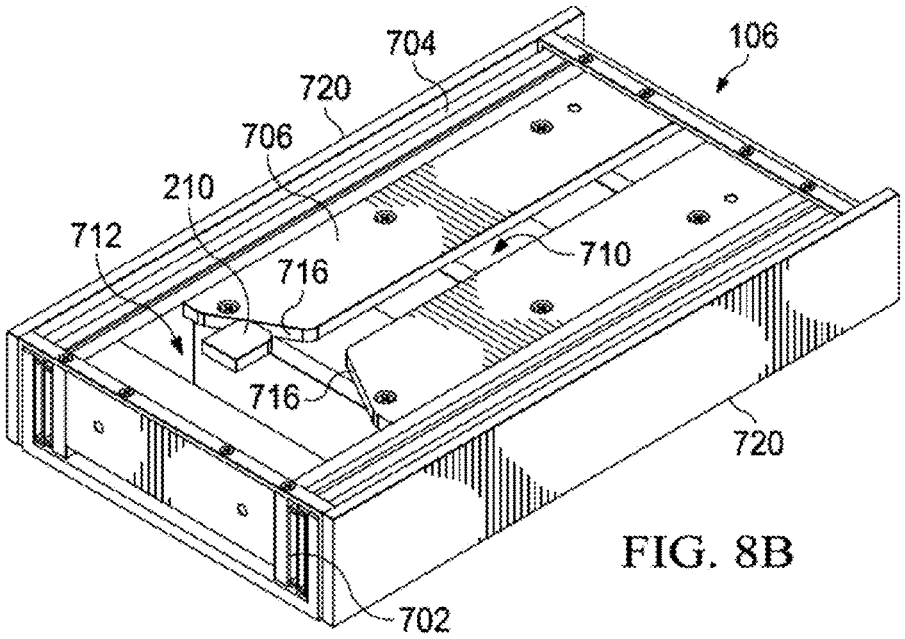
FIG. 8B is an isometric view of a base slide box of a preferred embodiment with a pin block in an initial position.
Figure 8C:
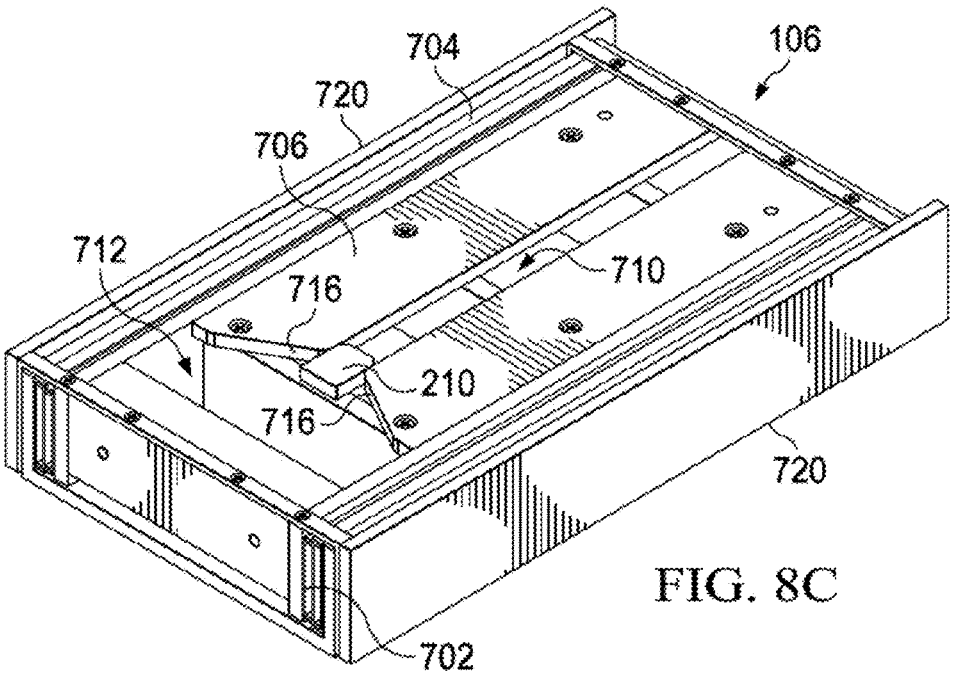
FIG. 8C is an isometric view of a base slide box of a preferred embodiment with a pin block in an intermediate position.
Figure 8D:
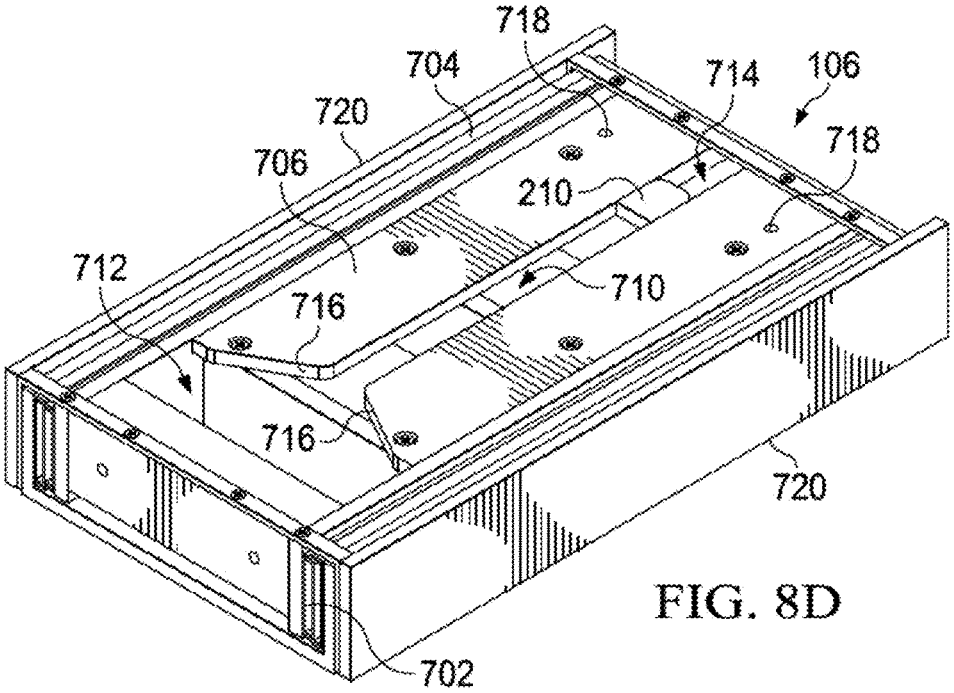
FIG. 8D is an isometric view of a base slide box of a preferred embodiment with a pin block in a final position.

Referring to FIG. 8A, the steps to install drawer box 102 in cabinet 108 are shown. At step 802, frame 704 is rigidly affixed to the cabinet carcass with standard mounting hardware such as wood screws through mounting holes 708. At step 804, "L" bracket 306 is mounted to the back of the cabinet carcass with mounting hardware such as wood screws through mounting slots 522. If necessary, vertical or horizontal adjustments of the position of "L" bracket 306 can be made without completely removing the mounting hardware due to the slotted shape of mounting slots 522. At step 806, "U" bracket 302 is connected to front panel 202 and rear panel 211 with typical mounting hardware such as wood screws through mounting slots 314. Vertical adjustments of bracket 302 are possible through the length of mounting slots 314. At step 808, drawer box 102 is positioned over template 706 such that pin block 210 is adjacent redirecting surfaces 716 at first end 712 as shown in FIG. 8B. At step 810, as drawer box 102 is pushed inward towards the cabinet, redirecting surfaces 716 guide pin block 210 towards slot 710 as shown in FIG. 8C. At step 812, as drawer box 102 is further forced towards the cabinet, pin block 210 moves through the length of slot 710 to second end 714 effectively centering drawer box 102 over base slide box 106 as shown in FIG. 8D. Pin block 210 moves through slot 710 until front panel 202 abuts template 706, mounting holes 724 are adjacent mounting holes 208, and mounting holes 212 are aligned with mounting holes 718. At step 814, drawer box 102 is attached to template 706.

At step 816, "T" bracket 304 is attached to outer rail 406 such that outer rail is positioned in between and adjacent sides 510. Curves 530 hook around outer rail 406. Tabs 504 abut outer rail 406 and position outer rail 406 centrally between sides 510. The inward bias of tabs 504 allows "T" bracket 304 to accommodate different possible widths of outer rail 406. Once "T" bracket 304 is positioned on outer rail 406, flexible tabs 502 are bent downwardly such that hooks 503 engage mounting holes 408 on outer rail 406. The engagement of hooks 503 with mounting holes 408 prevents rail assembly 308 from sliding out of engagement with brackets 304 and 306.

At step 818, rail assembly 308 is attached to "L" bracket 306 such that outer rail 406 is positioned in between and adjacent sides 516. Curves 532 hook around outer rail 406. Tabs 518 abut outer rail 406 and position outer rail 406 centrally between sides 516. The inward bias of tabs 518 allows "L" bracket 306 to accommodate different possible widths of outer rail 406. The length of web 514 provides depth adjustment capability if needed. "T" bracket 304 is then mounted to the cabinet carcass at step 820.

Figure 9:
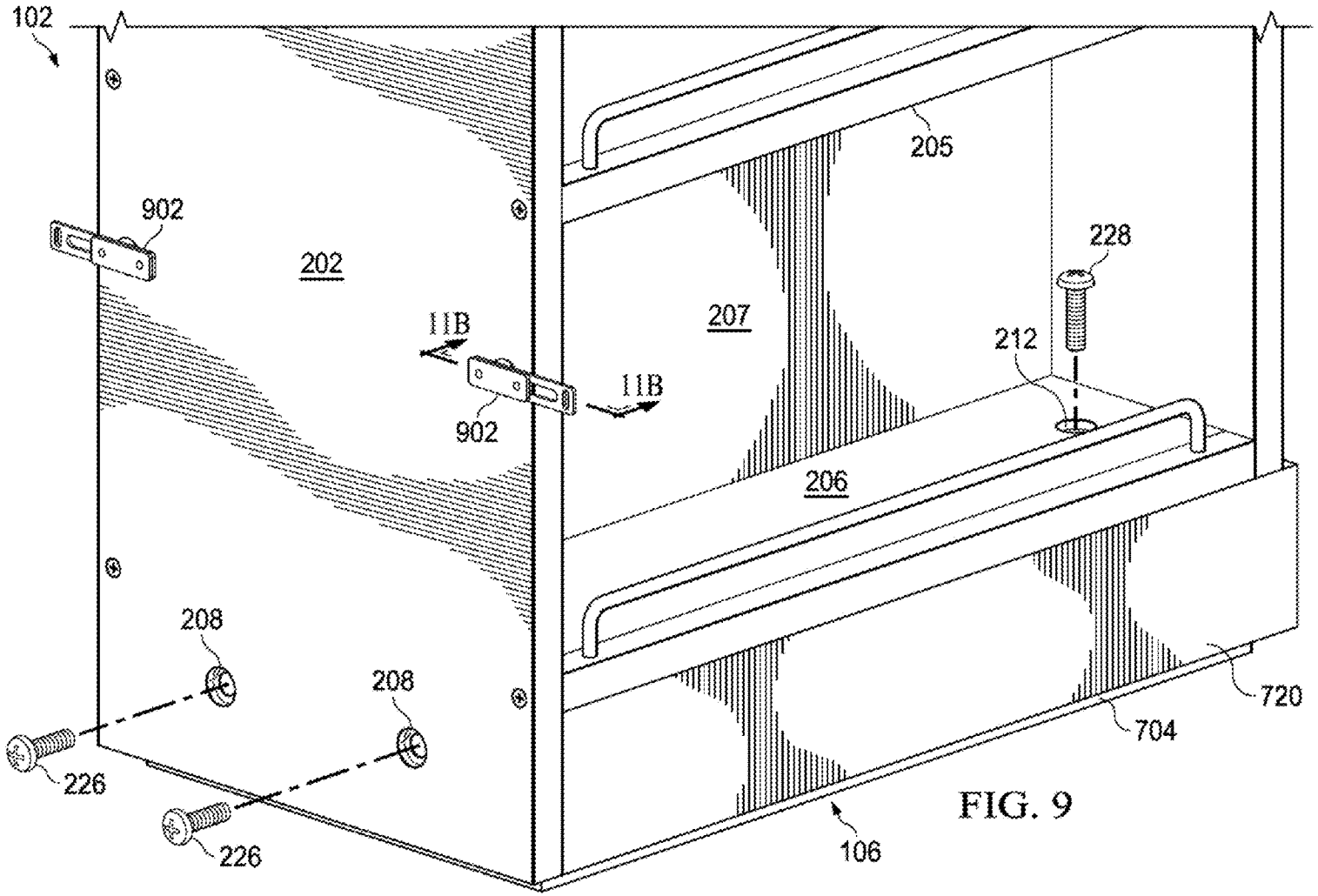
FIG. 9 is a partial isometric view of a drawer box mounted to a base slide box of a preferred embodiment.

Referring to FIG. 9, drawer box 102 is shown mounted to base slide box 106 in the stowed position (cabinet walls are not depicted). Screws 226 are used to attach drawer box 102 to base slide box 106 through mounting holes 208 and 724. Screws 228 are used to attach drawer box 102 to base slide box 106 through mounting holes 212 and 718 on both sides of vertical partition 207. Mounting system 902 is attached to front panel 202 and is used to adjustably attach a decorative face plate to front panel 202. It is understood that mounting system 902 can be implemented on any furniture or cabinet piece such as a base pullout, a filler pullout, a trash can pullout, or similar piece that incorporates a face plate.

Figure 10:
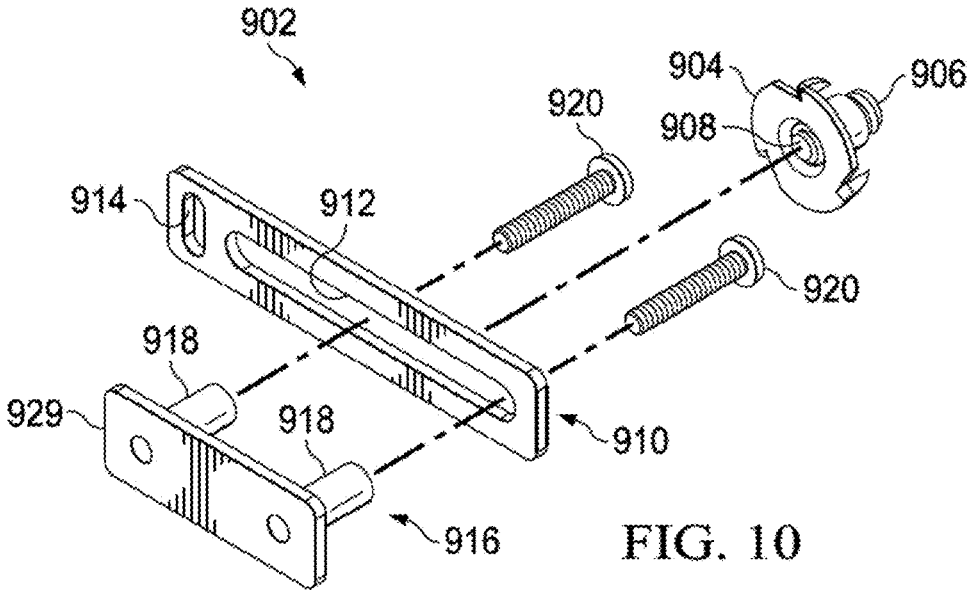
FIG. 10 is an isometric view of an adjustable face plate mounting system of a preferred embodiment.

Referring to FIG. 10, mounting system 902 comprises T-nut 904, slotted bracket 910, and standoff assembly 916. T-nut 904 includes a set of internal threads sized to engage set screw 906. Set screw 906 has a blunt surface 908 on one end. Slotted bracket 910 is generally rectangular and defines slot 912 through the majority of its length. Adjacent slot 912 at one end of slotted bracket 910 is attachment hole 914.

Standoff assembly 916 includes a pair of cylindrical, internally threaded standoffs 918 spaced a set distance apart from each other and extending from base 929. Standoffs 918 are slidably engaged with slot 912. Bolts 920 are externally threaded and sized to engage the internal threads of standoffs 918. Bolts 920 may be provided with a wide head or alternatively, washers may be used.

Figure 11A:
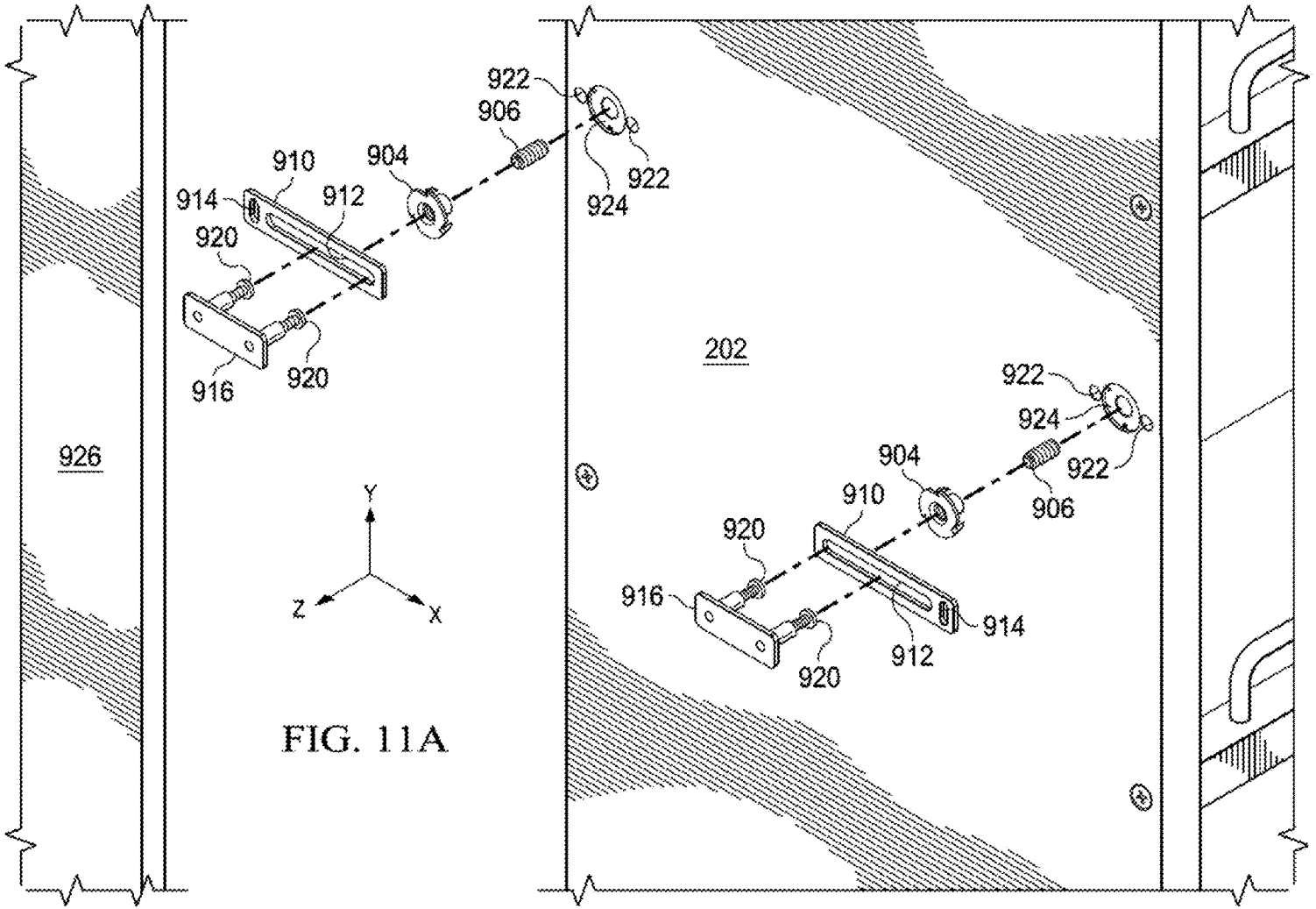
FIG. 11A is a partial exploded isometric view of an adjustable face plate mounting system and a front panel of a drawer box of a preferred embodiment.
Figure 11B:
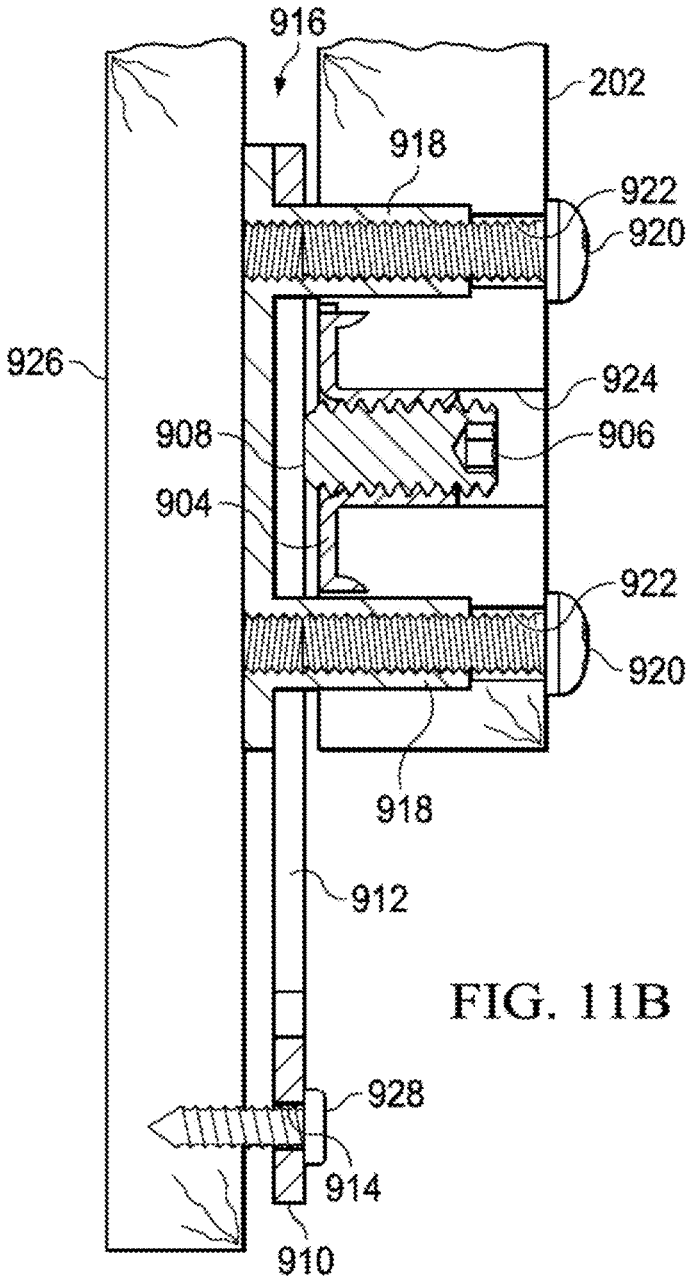
FIG. 11B is a partial cross-sectional view of an adjustable face plate mounting system attaching a face plate to a front panel of a drawer box of a preferred embodiment taken along line 11B-11B of FIG. 9.

Referring to FIGS. 11A and 11B, face plate 926 is adjustably secured to front panel 202 via mounting system 902. Bore 924 passes through front panel 202 and includes a recess to accommodate the head of T-nut 904 so that T-nut 904 is ultimately flush with the surface of front panel 202. Holes 922 pass through front panel 202 and are linearly aligned with bore 924. Holes 922 are spaced and sized to accept both standoffs 918 of standoff assembly 916. Screw 928 attaches face plate 926 to slotted bracket 910 through attachment hole 914.

Figure 12:
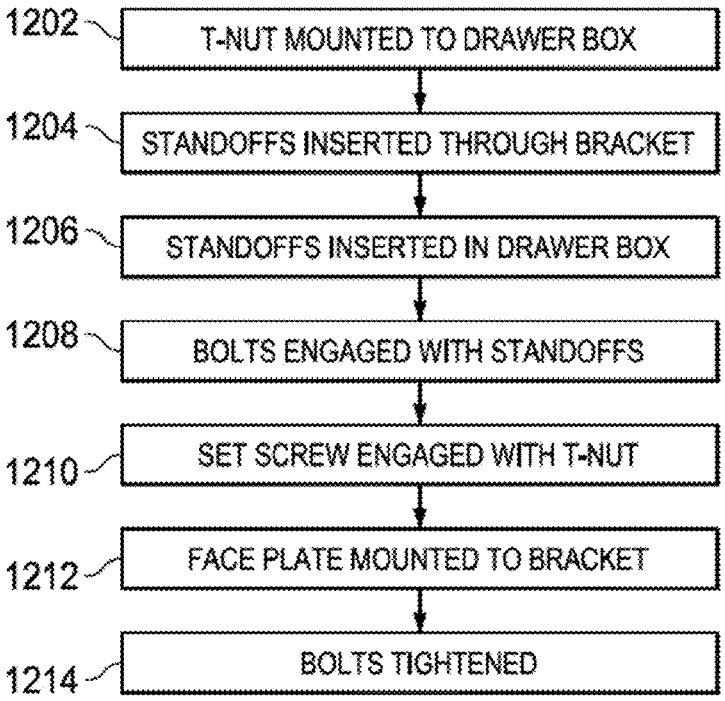
FIG. 12 is a flowchart of the steps involved in securing a face plate to a drawer box of a preferred embodiment.

Referring to FIG. 12, the steps to secure face plate 926 to front panel 202 are shown. At step 1202, T-nut 904 is rigidly mounted to front panel 202 in bore 924. At step 1204, after removing bolts 920 from standoffs 918, standoffs 918 are inserted through slot 912. At step 1206, standoffs 918 are inserted in holes 922 such that standoffs 918 terminate within panel 202. At step 1208, bolts 920 are threadably engaged with standoffs 918 and tightened to the point that base 929 is adjacent slotted bracket 910 and slotted bracket is adjacent front panel 202. At step 1210, set screw 906 is threadably engaged with T-nut 904 such that surface 908 abuts slotted bracket 910. Typical mounting hardware such as wood screws are used to mount face plate 926 to slotted bracket 910 through attachment hole 914 at step 1212. At step 1214, bolts 920 are tightened. It is preferred that a complete mounting system 902 is fitted proximate each corner of front panel 202.

Figure 13:
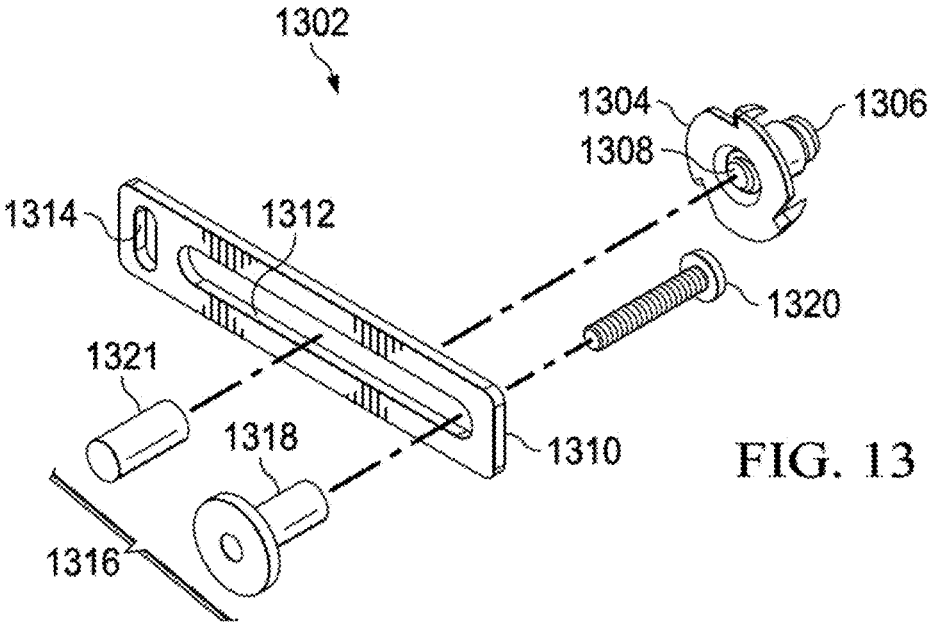
FIG. 13 is an isometric view of an adjustable face plate mounting system of a preferred embodiment.

Referring to FIG. 13, an alternate embodiment mounting system 1302 is shown. Mounting system 1302 comprises T-nut 1304, slotted bracket 1310, and standoff assembly 1316. T-nut 1304 includes a set of internal threads sized to engage set screw 1306. Set screw 1306 has a blunt surface 1308 on one end. Slotted bracket 1310 is generally rectangular and defines slot 1312 through the majority of its length. Adjacent slot 1312 at one end of slotted bracket 1310 is attachment hole 1314. Standoff assembly 1316 comprises a cylindrical, internally threaded standoff 1318. Standoff 1318 is slidably engaged with slot 1312. Bolt 1320 is externally threaded and sized to engage the internal threads of standoff 1318. Bolt 1320 may be provided with a wide head or alternatively, washers may be used. Alternatively, standoff 1318 may be externally threaded and fitted with a securing nut. Pin 1321 is generally cylindrical with a diameter approximately equivalent to the diameter of standoff 1318. Pin 1321 is slidably engaged with slot 1312.

Figure 14A:
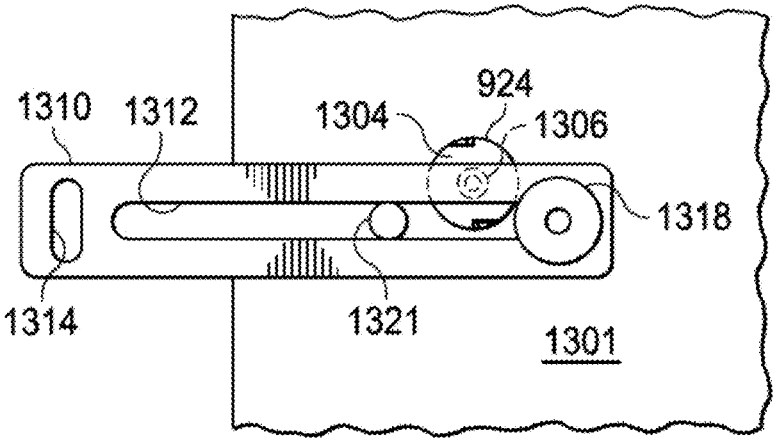
FIG. 14A is a partial elevation view of an adjustable face plate mounting system and a front panel of a drawer box of a preferred embodiment.
Figure 14B:
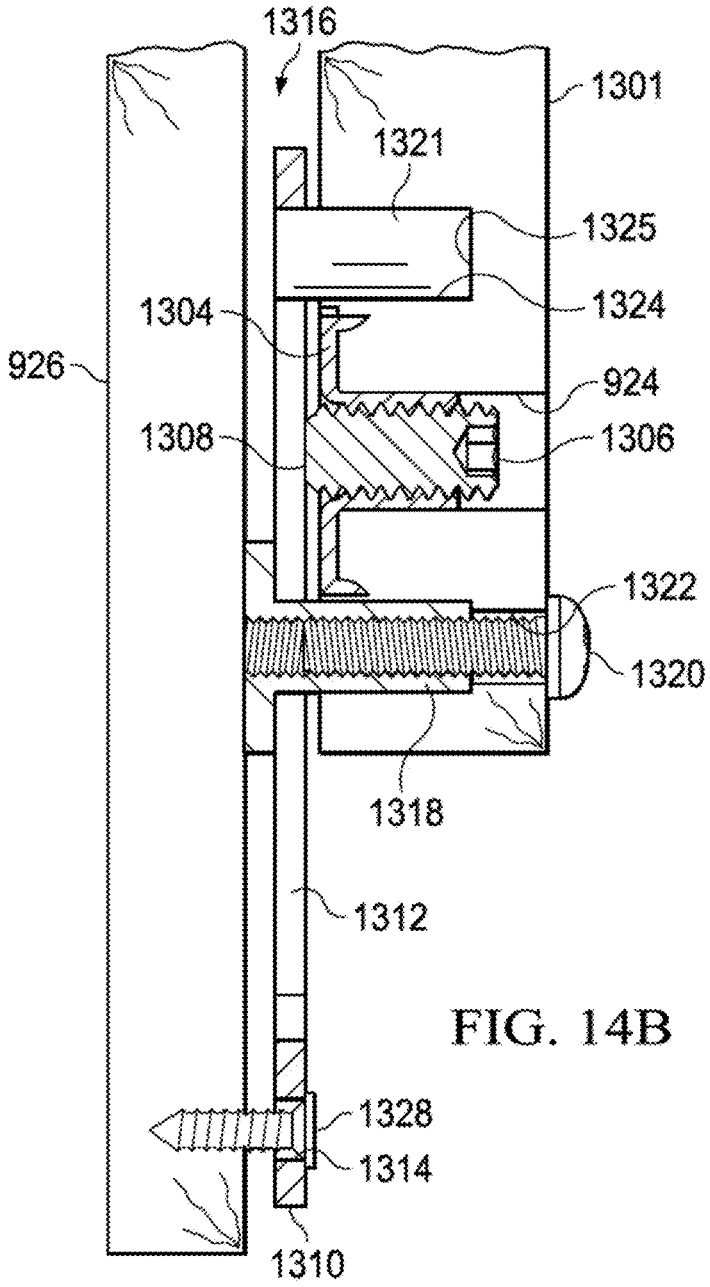
FIG. 14B is a partial cross-sectional view of an adjustable face plate mounting system attaching a face plate to a front panel of drawer box of a preferred embodiment.

Referring to FIGS. 14A and 14B, face plate 926 is adjustably secured to front panel 1301 via mounting system 1302. Bore 924 passes through front panel 1301 and includes a recess to accommodate the head of T-nut 1304 so that T-nut 1304 is ultimately flush with the surface of front panel 1301. Hole 1322 passes through front panel 1301. Hole 1324 has end 1325. Hole 1322 is sized to accept standoff 1318 and hole 1324 is sized to accept pin 1321. Screw 1328 attaches face plate 926 to slotted bracket 1310 through attachment hole 1314.

The position of face plate 926 relative to front panel 1301 can be adjusted in three dimensions in order to ensure that the face plate aligns with adjacent cabinets.

Figure 15A:
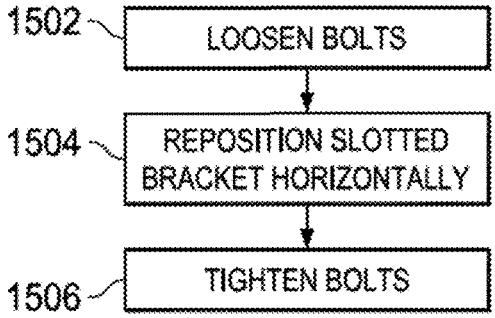
FIG. 15A is a flowchart of the steps involved in adjusting a horizontal position of a face plate relative to a drawer box of a preferred embodiment.

Referring to FIG. 15A, the steps to make a horizontal adjustment of face plate 926 relative to front panel 1301 (direction X) are shown. Bolts 920 are loosened at step 1502. At step 1504, face plate 926 and slotted bracket 910 are moved horizontally together such that slotted bracket 910 slides on standoffs 918 in direction X along slot 912. At step 1506, bolts 920 are tightened.

Figure 15B:
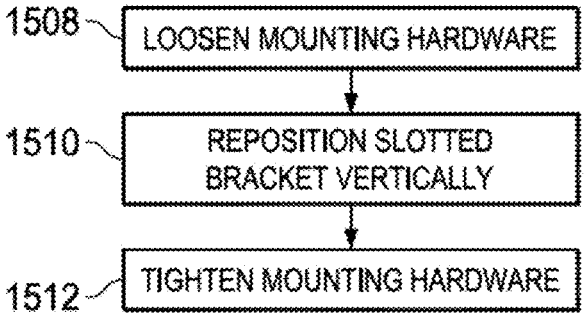
FIG. 15B is a flowchart of the steps involved in adjusting a vertical position of a face plate relative to a drawer box of a preferred embodiment.

Referring to FIG. 15B, the steps to make a vertical adjustment of face plate 926 relative to front panel 1301 (direction Y), are shown. Screw 928 securing face plate 926 to slotted bracket 910 through attachment hole 914 is loosened at step 1508. At step 1510, face plate 926 is moved vertically such that screw 928 slides along attachment hole 914 in direction Y. At step 1512, screw 928 securing face plate 926 to slotted bracket 910 through attachment hole 914 is tightened.

Figure 15C:
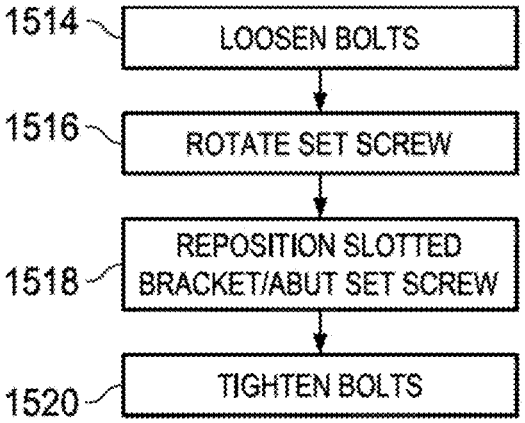
FIG. 15C is a flowchart of the steps involved in adjusting a depth position of a face plate relative to a drawer box of a preferred embodiment.
Figure 16A:
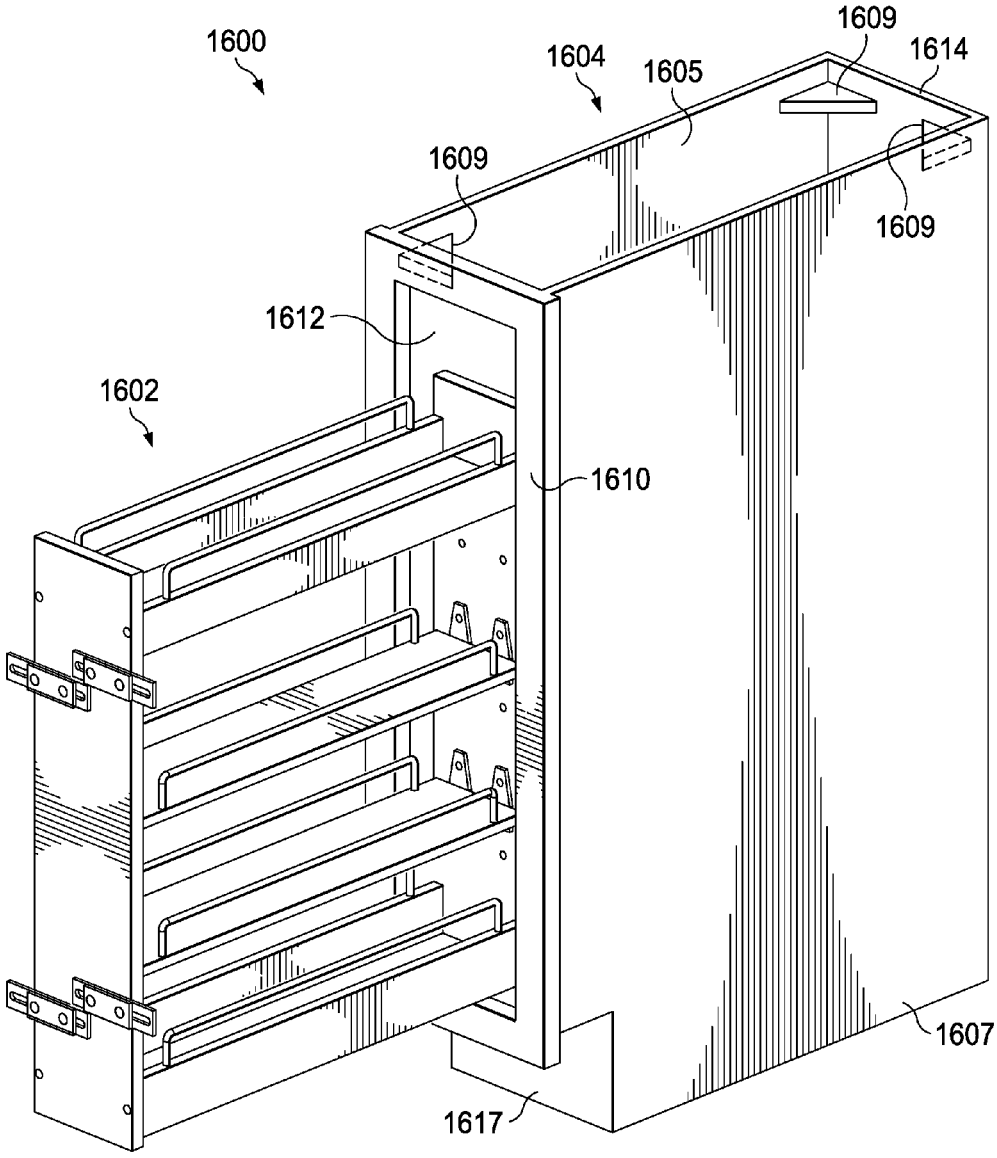
FIG. 16A is an isometric view of an alternate embodiment in a deployed position.
Figure 16B:
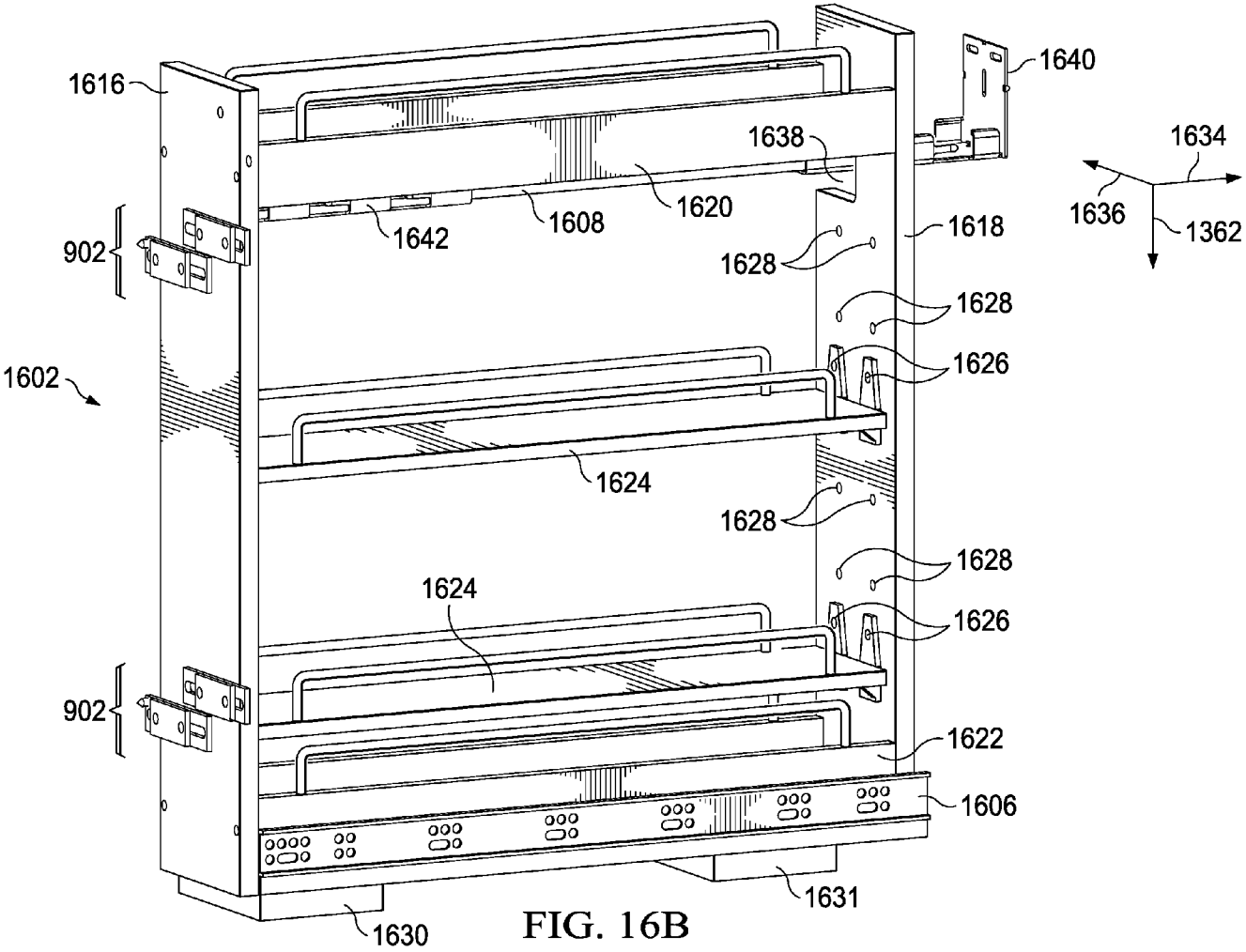
FIG. 16B is an isometric view of an alternate embodiment.
Figure 16C:
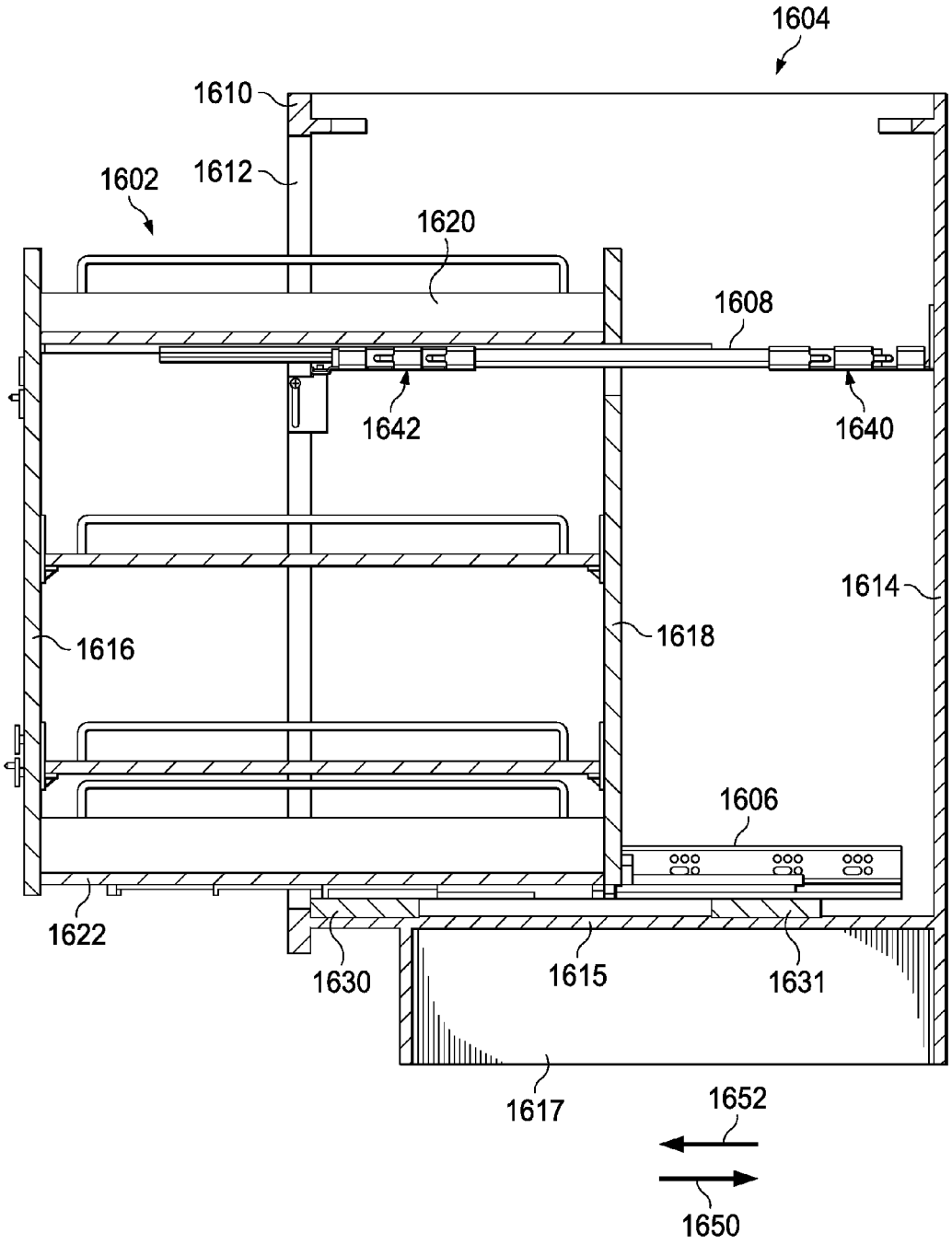
FIG. 16C is a side view of an alternate embodiment.
Figure 16D:
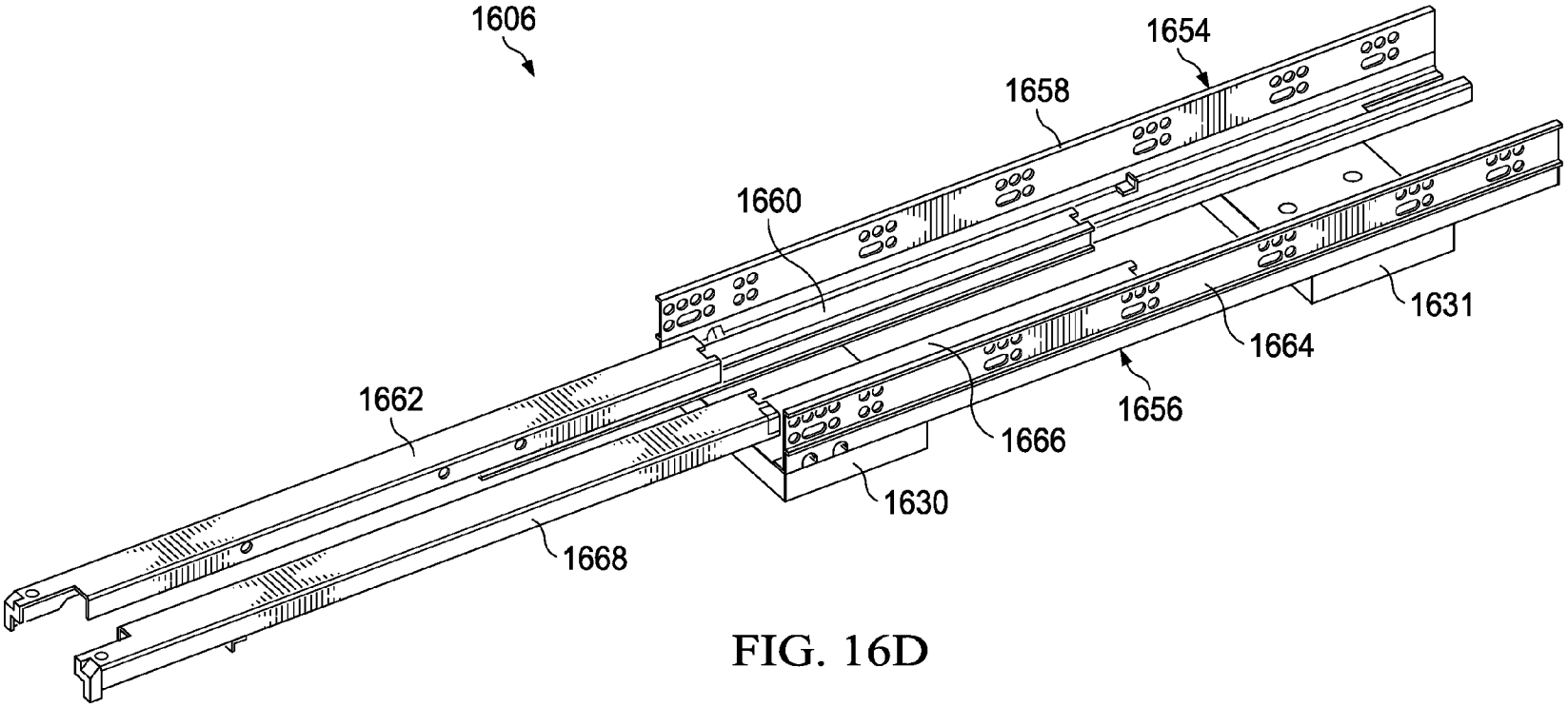
FIG. 16D is an isometric view of a lower drawer slide assembly of an alternate embodiment.

Referring to FIG. 15C, the steps to make a depth adjustment of face plate 926 relative to front panel 1301 (direction Z), are shown. Bolts 920 are loosened at step 1514. At step 1516, set screw 906 is rotated and advanced or retreated through T-nut 904 in direction Z. At step 1518 slotted bracket 910 is positioned to abut surface 908. At step 1520, bolts 920 are tightened.

Referring to FIGS. 16A-16D, an alternate embodiment, cabinet pullout apparatus 1600 comprises drawer box 1602 slidably mounted within cabinet carcass 1604. Drawer box 1602 is connected to and slidable within cabinet carcass 1604. As with earlier described embodiments, drawer box 1602 is slidable between a "stowed" position within the cabinet carcass and a "deployed" position outside the cabinet carcass. In the stowed position, the drawer box and its contents are hidden from view. In the deployed position, the contents stored on the shelves are visible and capable of being easily reached from either side.

Cabinet carcass 1604 is generally rectangular and is comprised of sides 1605 and 1607 connected to rear panel 1614 and bottom surface 1615. Bottom surface 1615 is elevated from the floor surface by pedestal section 1617. Cabinet carcass 1604 further includes face frame 1610 connected to sides 1605 and 1607 and bottom surface 1615. Face frame 1610 surrounds cabinet opening 1612. Face frame 1610 and cabinet opening 1612 are opposite rear panel 1614. Braces 1609 are mounted in the corner junctions of the sides with rear panel 1614 and face frame 1610. Braces are generally triangular and provide stability against lateral forces on the cabinet carcass while ensuring the connections of sides 1605 and 1607 to face frame 1610 and rear panel 1614 remain generally square. In an alternate embodiment, cabinet carcass 1604 includes less than four, but at least one brace 1609.

Drawer box 1602 is generally rectangular and is comprised of front panel 1616 connected to rear panel 1618 by a plurality of shelves. Fixed shelves 1620 and 1622 are rigidly connected to and generally perpendicular with both front panel 1616 and rear panel 1618. A plurality of adjustable shelves 1624, one or more, span the distance between front panel 1616 and rear panel 1618. The fixed shelves and the adjustable shelves are generally aligned with each other. The vertical position of each adjustable shelf 1624 can be changed by repositioning supporting pins 1626 in a series of evenly spaced and aligned mounting holes 1628 in front panel 1616 and rear panel 1618 located between fixed shelves 1620 and 1622. Rear panel 1618 includes cutout 1638. Mounting system 902 is attached to front panel 1616 and is used to adjustably attach a decorative face plate to front panel 1616 as previously described. In a preferred embodiment, drawer box 1602 is formed of wood, particle board, or polyvinyl chloride (PVC).

Lower drawer slide assembly 1606 is comprised of a pair of telescoping, undermount drawer slides 1654 and 1656 positioned side by side. Drawer slide 1654 includes base rail 1658, intermediate rail 1660, and inner rail 1662. Drawer slide 1656 includes base rail 1664, intermediate rail 1666, and inner rail 1668. Inner rails 1162 and 1668 are mounted to drawer box 1602 underneath fixed shelf 1622. Base rails 1658 and 1664 are mounted to support blocks 1630 and 1631. Support blocks 1630 and 1631 are attached to bottom surface 1615. Support block 1630 is adjacent face frame 1610. In the preferred embodiment, support blocks 1630 and 1631 are the same thickness. In an alternate embodiment, support block 1630 is slightly thicker than support block 1631 thus creating a downward slope in direction 1650 which provides a self-close functionality of drawer box 1602. Accordingly the different thickness of the support blocks creates an upward slope in direction 1652 which helps to reduce the opening speed of drawer box 1602. Lower drawer slide assembly 1606 may or may not incorporate a soft close mechanism.

Upper drawer slide 1608 is comprised of a telescoping, caged ball-bearing slide assembly having a base rail, an intermediate rail, and an inner rail. Upper drawer slide 1608 is mounted to drawer box 1602 underneath fixed shelf 1620. Upper drawer slide 1608 is mounted to rear panel 1614 via rear bracket 1640. Upper drawer slide 1608 is mounted to face frame 1610 via bracket 1642. Rear bracket 1640 and bracket 1642 provide positional adjustability of upper drawer slide 1608 in three directions, vertical 1632, horizontal 1634, and depth 1636.

Figure 17:
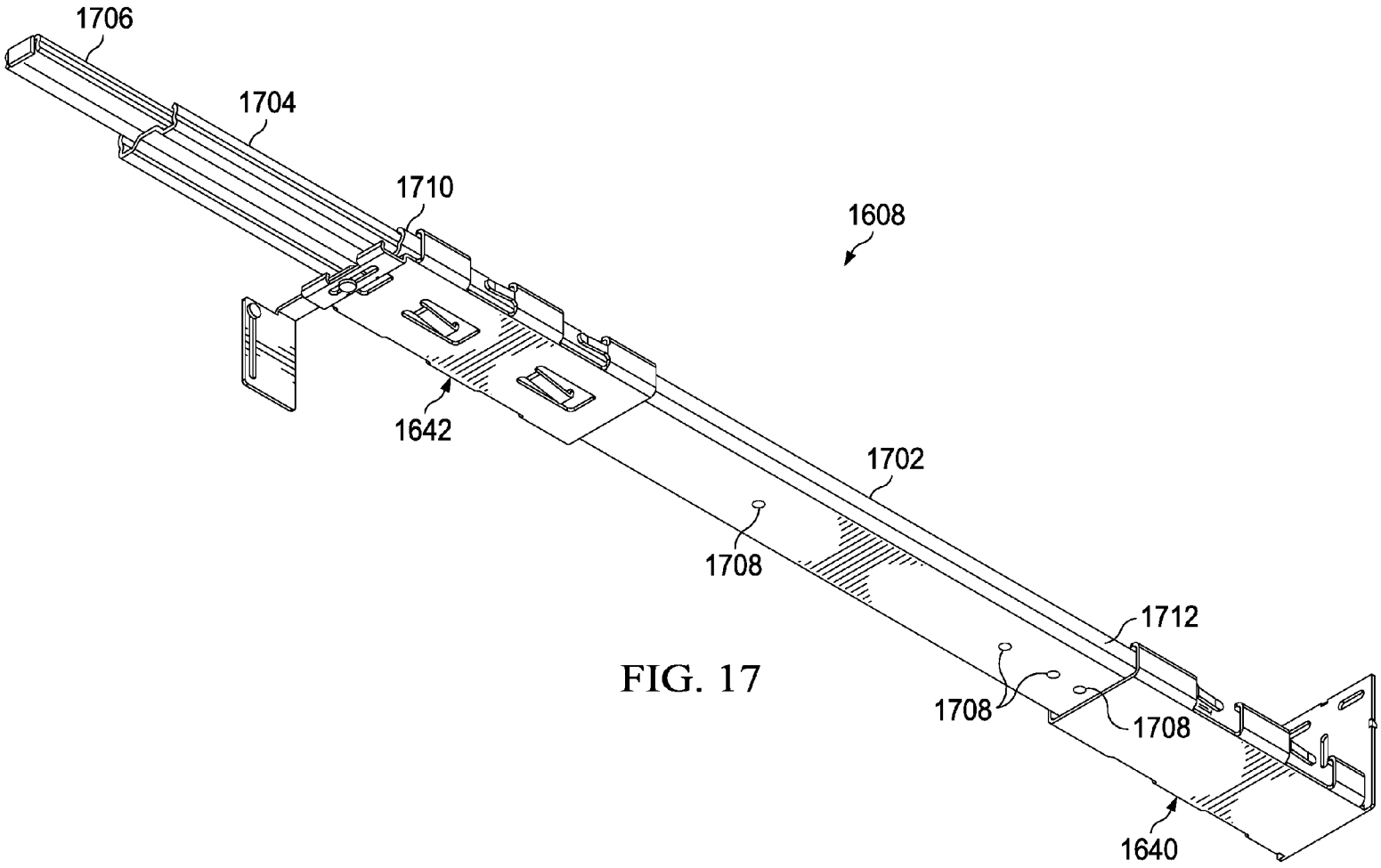
FIG. 17 is an isometric view of an upper drawer slide assembly of an alternate embodiment.

Referring to FIG. 17, upper drawer slide 1608 comprises outer rail 1702 telescopically engaged with intermediate rail 1704 telescopically engaged with inner rail 1706. Outer rail 1702 has end 1710 from which the intermediate and inner rail extend. Outer rail 1702 further includes end 1712 opposite end 1710. Bracket 1642 adjustably engages outer rail 1702 at end 1710. Rear bracket 1640 adjustably engages outer rail 1702 at end 1712. Inner rail 1706 is mounted to the underside of fixed shelf 1620. Intermediate rail 1704 telescopically extends through cutout 1638 during deployment of drawer box 1602 from cabinet carcass 1604. Outer rail 1702 includes linearly aligned mounting holes 1708. Mounting holes 1708 are positioned along the longitudinal center axis of outer rail 1702.

Figure 18:
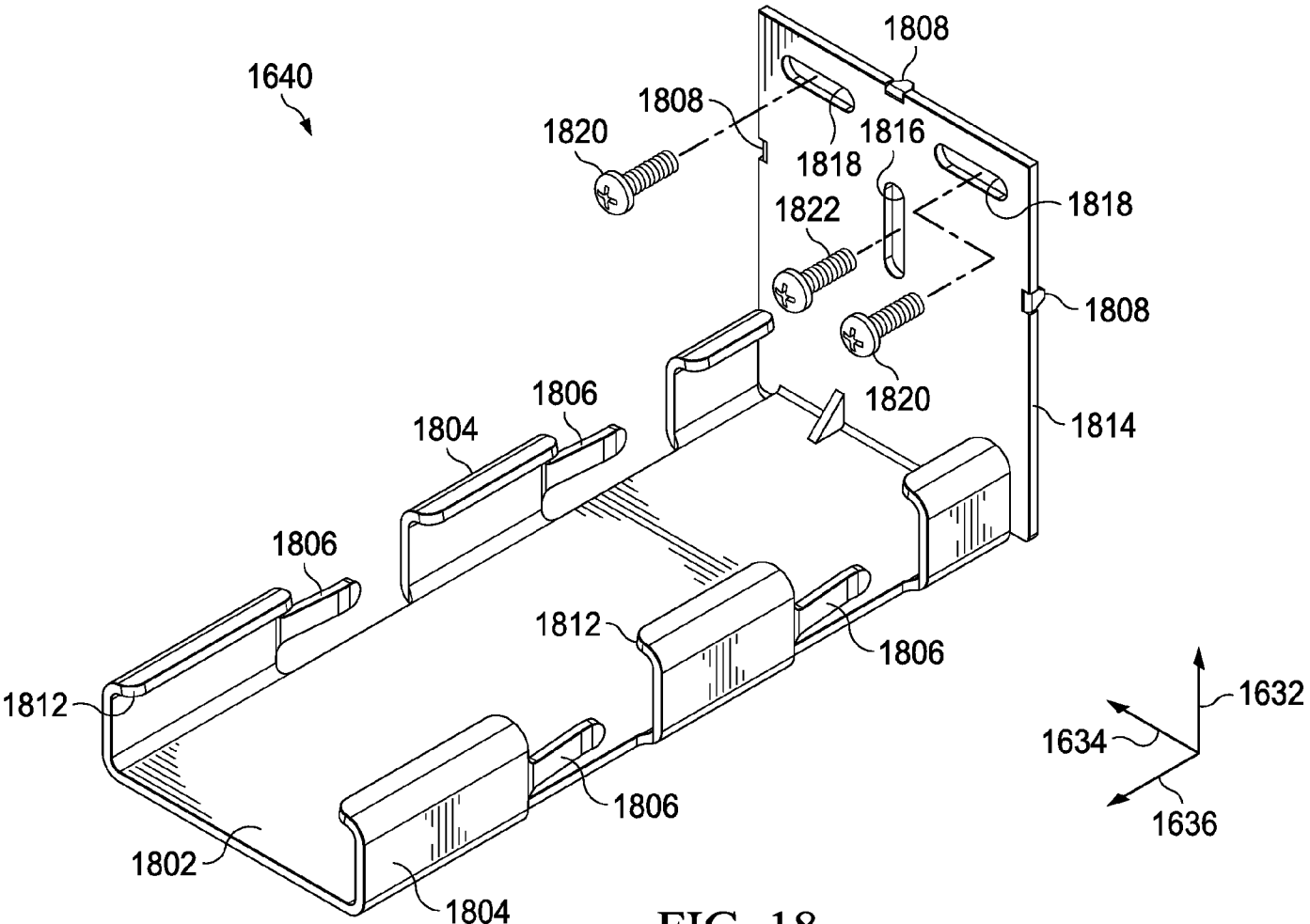
FIG. 18 is an isometric view of a rear bracket of an alternate embodiment.

Referring to FIG. 18, rear bracket 1640 is shown. Rear bracket 1640 releasably engages outer rail 1702. Rear bracket 1640 has web 1802 integrally formed with and separating sides 1804. Tabs 1806 extend from each of sides 1804. Tabs 1806 are angled inward towards web 1802 such that they act as a spring and provide an inward bias. Sides 1804 extend from web 1802 and include curves 1812. Curves 1812 extend around outer rail 1702. Tabs 1806 abut outer rail 1702 and position outer rail 1702 centrally between sides 1804. The inward bias of tabs 1806 allows bracket 1640 to accommodate different possible widths of outer rail 1702. Flange 1814 extends generally perpendicularly from web 1802 and includes mounting slots 1816 and 1818. Prongs 1808 extend from flange 1814. Prongs 1808 provide indentation marks on rear panel 1614 for ease of alignment. Rear bracket 1640 mounted to rear panel 1614 provides positional adjustability of upper drawer slide 1608 at end 1712 in three directions, vertical 1632 via screw 1822 along slot 1816, horizontal 1634 via screws 1820 along slots 1818, and depth 1636 via tabs 1806 frictionally engaging outer rail 1702.

Figure 19A:
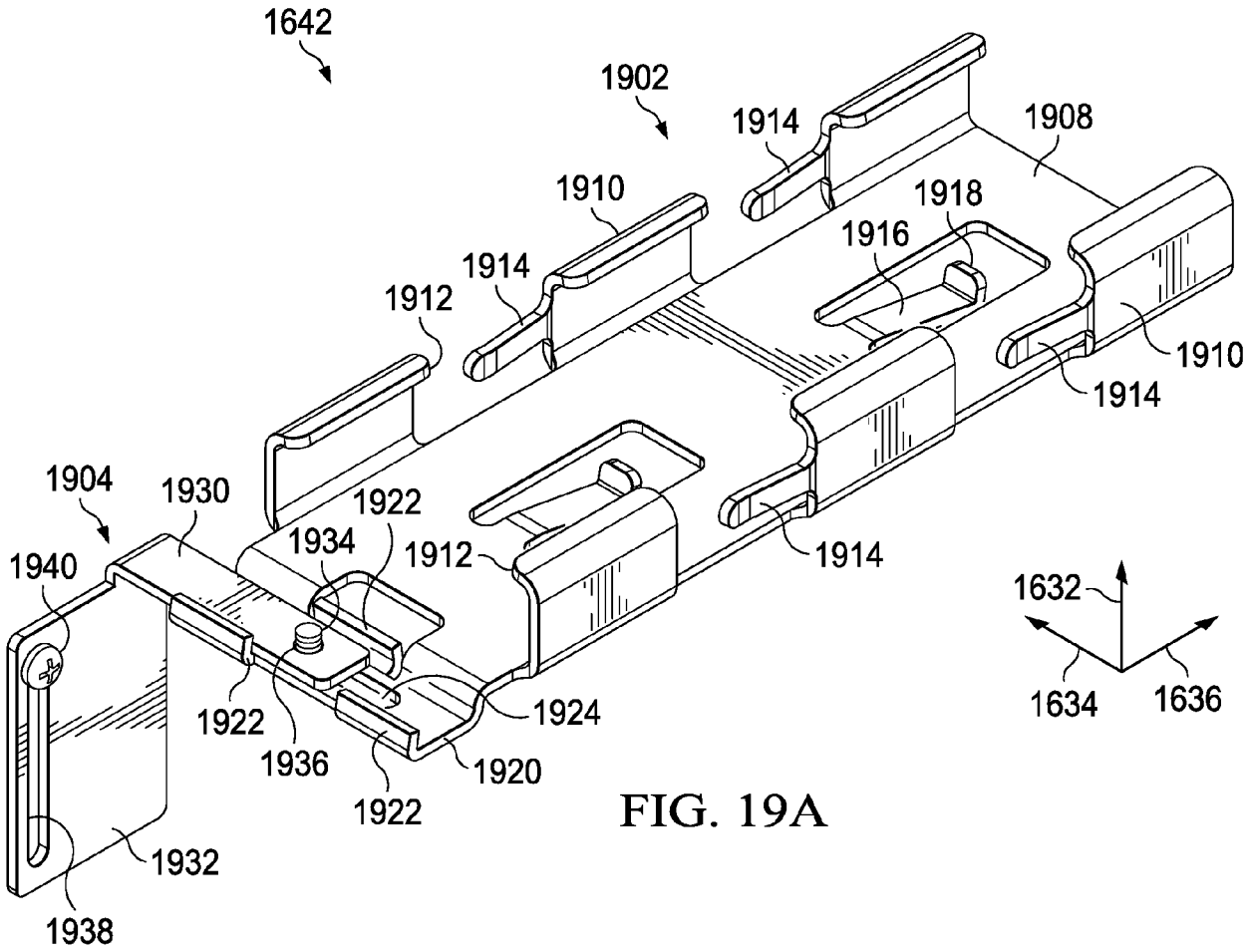
FIG. 19A is an isometric view of a bracket of an alternate embodiment.
Figure 19B:
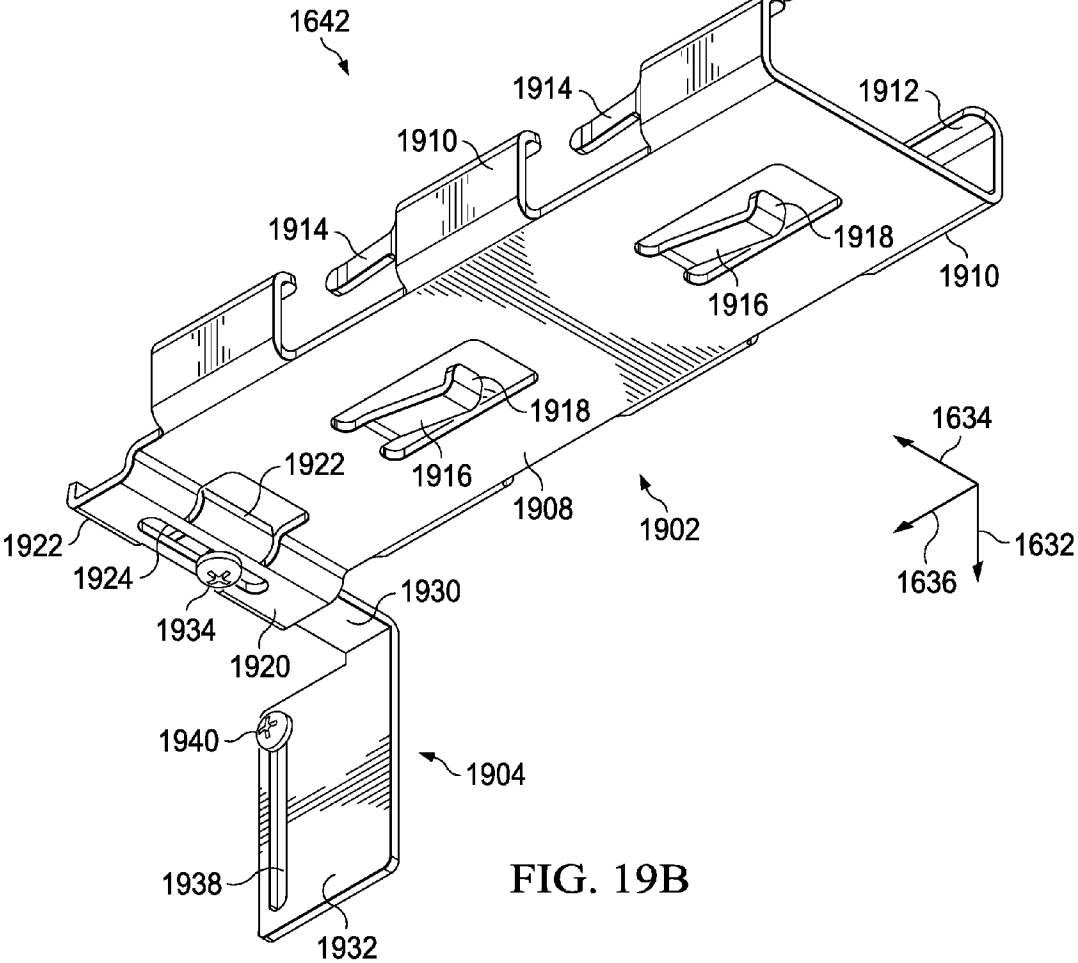
FIG. 19B is a second isometric view of a bracket of an alternate embodiment.

Referring to FIGS. 19A and 19B, bracket 1642 is shown. Bracket 1642 comprises body 1902 slidably engaged with slider 1904.

Body 1902 releasably engages outer rail 1702. Body 1902 comprises web 1908 integrally formed with sides 1910. Sides 1910 extend from web 1908 and include curves 1912. Tabs 1914 extend from each of sides 1910. Tabs 1914 are angled inward towards web 1908 such that they act as a spring and provide an inward bias. Curves 1912 hook around outer rail 1702 and tabs 1914 abut outer rail 1702. Tabs 1914 allow bracket 1642 to accommodate a range of widths of outer rail 1702. Flexible tabs 1916 extend from web 1908. Each flexible tab 1916 includes hook 1918 sized to engage mounting holes 1708 on outer rail 1702. Flange 1920 extends from body 1902. Flange 1920 includes curved sides 1922 and is sized to slidably receive slider 1904. Flange 1920 includes slot 1924.

Slider 1904 is generally "L" shaped comprising tongue 1930 extending generally perpendicularly from base 1932. Tongue 1930 is generally rectangular and sized to slidingly fit within curved sides 1922. Tongue 1930 includes tapped hole 1936. Bolt 1934 is sized to pass through slot 1924 and threadably engage tapped hole 1936. Bolt 1934 and tapped hole 1936 adjustably fasten tongue 1930 to flange 1920. Base 1932 is generally rectangular and includes slot 1938. Slider 1904 is adjustably mounted to face frame 1610 with standard mounting hardware such as wood screw 1940 through slot 1938. Bracket 1642 provides positional adjustability of upper drawer slide 1608 at end 1710 in three directions. Upper drawer slide 1608 can be adjusted vertically in direction 1632 via screw 1940 along slot 1938. Upper drawer slide 1608 can be adjusted horizontally in direction 1634 via bolt 1934 along slot 1924. Upper drawer slide 1608 can be adjusted in the depth direction 1636 via hooks 1918 releasably engaging mounting holes 1708 and tabs 1914 frictionally engaging outer rail 1702.

In use, it is important that the upper slide assembly is properly positioned relative to the cabinet carcass to decrease side-to-side movement and to prevent binding during deployment of drawer box 1602 from cabinet carcass 1604. Once lower drawer slide assembly 1606 is mounted to the support blocks and the drawer box and upper drawer slide 1608 is mounted to the cabinet carcass and the drawer box, it may be necessary to adjust the position of upper drawer slide 1608 relative to the cabinet carcass.

Figure 20A:
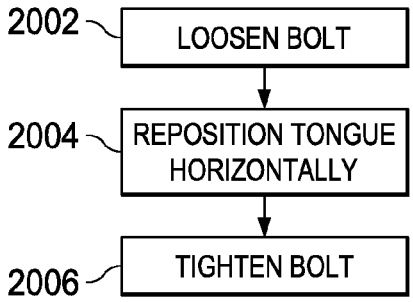
FIG. 20A is a flowchart of the steps involved in adjusting a horizontal position of an upper drawer slide relative to a cabinet carcass of an alternate embodiment.

Referring to FIG. 20A, the steps to make a horizontal adjustment in direction 1634 of end 1710 of upper drawer slide 1608 relative to cabinet carcass 1604 are shown. At step 2002, bolt 1934 is loosened. At step 2004, tongue 1930 is repositioned horizontally relative to flange 1920 while bolt 1934 is moved along slot 1924 until the desired horizontal position of upper drawer slide 1608 relative to cabinet carcass 1604 is achieved. At step 2006, bolt 1934 is tightened.

Figure 20B:
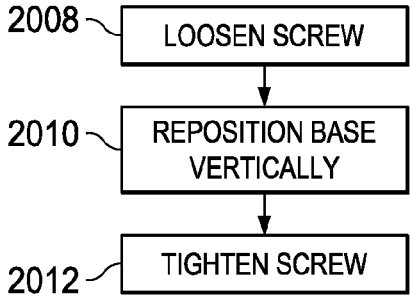
FIG. 20B is a flowchart of the steps involved in adjusting a vertical position of an upper drawer slide relative to a cabinet carcass of an alternate embodiment.

Referring to FIG. 20B, the steps to make a vertical adjustment in direction 1632 of end 1710 of upper drawer slide 1608 relative to cabinet carcass 1604 are shown. At step 2008, screw 1940 is loosened. At step 2010, base 1932 is repositioned vertically relative to the cabinet carcass while screw 1940 is moved along slot 1938 until the desired vertical position of upper drawer slide 1608 relative to cabinet carcass 1604 is achieved. At step 2012, screw 1940 is tightened.

Figure 20C:
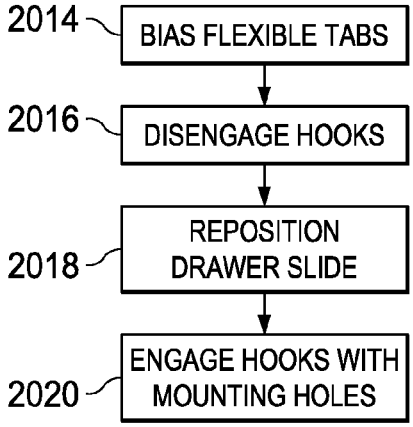
FIG. 20C is a flowchart of the steps involved in adjusting a depth position of an upper drawer slide relative to a cabinet carcass of an alternate embodiment.

Referring to FIG. 20C, the steps to make a depth adjustment in direction 1636 of upper drawer slide 1608 relative to cabinet carcass 1604 are shown. At step 2014, flexible tabs 1916 are biased away from outer rail 1702. At step 2016, hooks 1918 are disengaged from mounting holes 1708. At step 2018, upper drawer slide 1608 is repositioned in depth direction 1636 relative to bracket 1642 and rear bracket 1640 until the desired depth is reached. At step 2020, hooks 1918 engage mounting holes 1708.

It will be appreciated by those skilled in the art that modifications can be made to the embodiments disclosed and remain within the inventive concept. Therefore, this invention is not limited to the specific embodiments disclosed, but is intended to cover changes within the scope and spirit of the claims.

The invention claimed is:

1. A cabinet pullout apparatus for slidable engagement with a cabinet carcass comprising:

a generally rectangular drawer box configured to be slidably stowable within and deployable from the cabinet carcass;

a bracket, having a slider slidably engaged with a body, where the slider is configured to be mounted to the cabinet carcass;

an upper slide assembly mounted to the drawer box and releasably engaged with the body;

wherein the bracket provides an adjustment of a position of the upper slide assembly relative to the cabinet carcass in at least three directions;

a rear bracket releasably engaged with the upper slide assembly; and, the rear bracket having a web connecting two sides and a flange extending from the web, where the flange is configured to be mounted to the cabinet carcass.

2. The cabinet pullout apparatus of claim 1 wherein the slider further comprises:

a tongue, extending generally perpendicular from a base, slidably engaged with the body; and, a vertically oriented slot in the base configured to receive mounting hardware for connection to the cabinet carcass.

3. The cabinet pullout apparatus of claim 1 wherein the body further comprises:

a first side and a second side integrally formed with and extending from a web;

a flange slidably engaged with the slider;

a first set of angled tabs extending from the first side and a second set of angled tabs extending from the second side where the first set of angled tabs and the second set of angled tabs abut the upper slide assembly; and, a set of flexible tabs extending from the web and releasably engaging the upper slide assembly.

4. The cabinet pullout apparatus of claim 1 wherein:

the slider further comprises a tongue extending from a base;

the body further comprises a flange slidably engaged with the tongue;

a first side and a second side integrally formed with and extending from a web;

a first set of angled tabs extending from the first side and a second set of angled tabs extending from the second side where the first set of angled tabs and the second set of angled tabs abut the upper slide assembly; and, a set of flexible tabs extending from the web and releasably engaging the upper slide assembly.

5. The cabinet pullout apparatus of claim 1 wherein the drawer box further comprises:

a front panel connected to a rear panel by a set of fixed shelves;

a set of adjustable shelves releasably connected to the front panel and the rear panel;

the upper slide assembly mounted to a first shelf of the set of fixed shelves; and, a set of lower slide assemblies mounted to a second shelf of the set of fixed shelves.

6. The cabinet pullout apparatus of claim 1 wherein the drawer box further comprises:

a front panel connected to a rear panel by a first fixed shelf and a second fixed shelf;

an upper slide assembly mounted to the underside of the first fixed shelf;

a set of lower slide assemblies mounted to the underside of the second fixed shelf; and, at least one adjustable shelf releasably connected to the front panel and the rear panel and positioned vertically between the first fixed shelf and the second fixed shelf.

7. A cabinet pullout apparatus for slidable engagement with a cabinet carcass comprising:

a generally rectangular drawer box configured to be slidably stowable within and deployable from the cabinet carcass;

a bracket, having a slider slidably engaged with a body, where the slider is configured to be mounted to the cabinet carcass;

an upper slide assembly mounted to the drawer box and releasably engaged with the body;

wherein the bracket provides an adjustment of a position of the upper slide assembly relative to the cabinet carcass in at least three directions; and, a set of lower slide assemblies mounted to the drawer box and mounted to a set of support blocks.

8. The cabinet pullout apparatus of claim 7 further comprising:

each lower slide assembly of the set of lower slide assemblies is an undermount slide assembly;

a first support block of the set of support blocks has a first thickness and a second support block of the set of support blocks has a second thickness; and, wherein the first thickness is not equal to the second thickness.

9. The cabinet pullout apparatus of claim 7 wherein the set of support blocks provide an inclined mounting surface for the set of lower slide assemblies.

10. The cabinet pullout apparatus of claim 7 wherein at least one lower slide assembly of the set of lower slide assemblies includes a soft close mechanism.

11. A cabinet pullout apparatus for slidable engagement with a cabinet carcass comprising:

a generally rectangular drawer box configured to be slidably stowable within and deployable from the cabinet carcass;

a bracket, having a slider slidably engaged with a body, where the slider is configured to be mounted to the cabinet carcass;

an upper slide assembly mounted to the drawer box and releasably engaged with the body;

wherein the bracket provides an adjustment of a position of the upper slide assembly relative to the cabinet carcass in at least three directions;

a first mounting hole in the drawer box and a second mounting hole in the drawer box, where the first mounting hole is spaced from the second mounting hole by a distance;

a face plate bracket defining a slot and an attachment hole;

a standoff assembly slidably engaged with the slot and inserted into the first mounting hole and the second mounting hole; and, a face plate attached to the face plate bracket.

* * * * *